US008099032B2

(12) United States Patent
Iwami et al.

(10) Patent No.: US 8,099,032 B2
(45) Date of Patent: Jan. 17, 2012

(54) IMAGE FORMING APPARATUS

(75) Inventors: Takatsugu Iwami, Tokyo (JP); Yoshie Tsuchida, Osaka (JP); Mitsutoshi Kichise, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 239 days.

(21) Appl. No.: 12/379,159

(22) Filed: Feb. 13, 2009
(Under 37 CFR 1.47)

(65) Prior Publication Data

US 2010/0239334 A1 Sep. 23, 2010

(30) Foreign Application Priority Data

Feb. 18, 2008 (JP) ..... 2008-035995
Nov. 21, 2008 (JP) ..... 2008-298720

(51) Int. Cl.
*G03G 15/20* (2006.01)

(52) U.S. Cl. ..... 399/313

(58) Field of Classification Search ..... 399/313; 492/18
See application file for complete search history.

(56) References Cited

U.S. PATENT DOCUMENTS

| | | | | |
|---|---|---|---|---|
| 7,428,400 | B2 * | 9/2008 | Iwakura et al. | 399/313 |
| 2006/0210326 | A1 | 9/2006 | Takehara et al. | |
| 2006/0210327 | A1 | 9/2006 | Iwakura et al. | |
| 2008/0101824 | A1 * | 5/2008 | Konishi | 399/313 |
| 2008/0152378 | A1 | 6/2008 | Yamashita et al. | |
| 2008/0226313 | A1 | 9/2008 | Tsuchida et al. | |

FOREIGN PATENT DOCUMENTS

| | | |
|---|---|---|
| JP | 08-095411 | 4/1996 |
| JP | 2005-215600 | 8/2005 |
| JP | 2006-072247 | 3/2006 |
| WO | WO 02/056119 | 7/2002 |

* cited by examiner

*Primary Examiner* — David Gray
*Assistant Examiner* — Frederick Wenderoth
(74) *Attorney, Agent, or Firm* — Harness, Dickey & Pierce, P.L.C.

(57) ABSTRACT

An image forming apparatus includes an image carrier; a movable endless belt member forming a nip between the image carrier; and a transfer roller made of metal contacting the belt member at a region corresponding to the nip. At the nip, a toner image on the image carrier is transferred onto the belt member. The transfer roller slidably rotates in bearings supporting its shaft. Members having a higher friction coefficient than that of the transfer roller are provided at end portions of the transfer roller. F1>F3 and F2>F4 are satisfied, where F1 is a maximum static friction between the transfer roller and the belt member, F2 is a dynamic friction between the transfer roller and the belt member, F3 is a maximum static friction between the shaft of the transfer roller and the bearings, and F4 is a dynamic friction between the shaft of the transfer roller and the bearings.

22 Claims, 9 Drawing Sheets

IMAGE FORMING APPARATUS

BACKGROUND OF THE INVENTION

1. Field of the Invention

The present invention relates to an image forming apparatus in which a toner image on an image carrier such as a photoconductor is transferred onto a front surface of an endless belt member or onto a recording material held on the belt, at a transfer nip formed where the image carrier abuts the belt.

2. Description of the Related Art

An image forming apparatus having the above-described configuration may employ an intermediate transfer method, for example. In such an image forming apparatus, a toner image corresponding to image information is formed on a photoconductor, and the toner image is transferred onto an intermediate transfer belt (endless belt member) by a primary transfer process. Then, the toner image on the intermediate transfer belt is transferred onto a sheet which is a recording material by a secondary transfer process, thereby forming an image on the sheet. In such an image forming apparatus, in the entire region on the back surface (the inner side of the loop) of the intermediate transfer belt which is a belt member, a primary transfer roller is caused to abut a region behind a primary transfer nip to apply a primary transfer bias, thus forming a primary transfer electric field between the photoconductor and the intermediate transfer belt. The shaft of the primary transfer roller is supported by bearings made of resin etc., and the primary transfer roller is caused to rotate by the intermediate transfer belt.

A conductive foam rubber roller, etc., is generally used as the primary transfer roller. The conductive foam rubber roller has a foamable conductive rubber layer provided around a cored bar, as described in patent document 1, for example.

The conductive foam rubber roller is expensive, and thus increases the cost of the apparatus. In particular, a tandem-type full-color image forming apparatus requires four primary transfer rollers, which significantly increases the cost of the apparatus.

Patent document 2 describes an image forming apparatus which includes a metal roller used as the primary transfer roller. Metal rollers cost less than conductive foam rubber rollers, and therefore the apparatus costs less than that with a conductive foam rubber roller.

Patent Document 1: International Application Publication No. WO02/056119

Patent Document 2: Japanese Laid-Open Patent Application No. 2006-072247

However, when a metal roller is used as the primary transfer roller, the following problem arises. That is, the surface of a metal roller has a low friction coefficient, and therefore tends to slip on the intermediate transfer belt. Particularly, the primary transfer roller tends to slip even more when foreign particles enter the part of the bearing that supports the shaft of the primary transfer roller, and the sliding resistance is increased between the bearing and the shaft of the primary transfer roller.

When the primary transfer roller slips, the back side of the intermediate transfer belt is scraped, as the intermediate transfer belt is made of rubber which is a softer material than metal. As a result, abrasion powder is generated, which is electrically fused with the primary transfer roller. If the primary transfer roller slips on the intermediate transfer belt in a state where the abrasion powder is fused with the primary transfer roller, the abrasion powder forms a film on the primary transfer roller. When such a film is formed, the resistance of the primary transfer roller increases, which makes the primary transfer electric field become insufficient and decrease the transfer efficiency. Accordingly, the image quality becomes degraded over time.

One approach for achieving stable transfer efficiency from the start and over time is to increase the primary transfer bias along with the passage of time. However, this requires complex control methods, which may increase the cost of the apparatus. Another approach is to attempt to scrape off the abrasion powder which has electrically fused with the primary transfer roller by having a cleaning blade abut against the primary transfer roller. However, the abrasion powder which is electrically fused with the primary transfer roller firmly adheres to the metal roller, and thus cannot be effectively removed with a cleaning blade.

SUMMARY OF THE INVENTION

The present invention provides an image forming apparatus in which one or more of the above-described disadvantages are eliminated.

A preferred embodiment of the present invention provides an image forming apparatus in which a transfer roller made of metal is prevented from slipping on an endless belt member.

According to an aspect of the present invention, there is provided an image forming apparatus including an image carrier configured to carry a toner image on a surface thereof; an endless belt member configured to move endlessly while being stretched around plural stretching members and to form a transfer nip by having a front surface thereof contact the image carrier; and a transfer roller configured to be rotated while contacting a region behind the transfer nip among the entire region on a back surface of the endless belt member, and to receive a transfer bias, wherein at the transfer nip, the toner image on the image carrier is transferred onto the front surface of the endless belt member or onto a recording material held by the endless belt member; the transfer roller includes a metal roller configured to slidably rotate in bearings supporting a shaft of the transfer roller; and $F1>F3$ and $F2>F4$ are satisfied, where F1 is a maximum static friction between the transfer roller and the endless belt member, F2 is a dynamic friction between the transfer roller and the endless belt member, F3 is a maximum static friction between the shaft of the transfer roller and slide parts of the bearings in which the shaft slidably rotates, and F4 is a dynamic friction between the shaft of the transfer roller and the slide parts of the bearings in which the shaft slidably rotates.

According to an aspect of the present invention, there is provided an image forming apparatus including an image carrier configured to carry a toner image on a surface thereof; an endless belt member configured to move endlessly while being stretched around plural stretching members and to form a transfer nip by having a front surface thereof contact the image carrier; and a transfer roller configured to be rotated while contacting a region behind the transfer nip among the entire region on a back surface of the endless belt member, and to receive a transfer bias, wherein at the transfer nip, the toner image on the image carrier is transferred onto the front surface of the endless belt member or onto a recording material held by the endless belt member; the transfer roller includes a metal roller configured to slidably rotate in bearings supporting a shaft of the transfer roller; and $F1>F3$ and $F2>F4$ are satisfied, where F1 is a maximum static friction between the transfer roller and the endless belt member, F2 is a dynamic friction between the transfer roller and the endless belt member, F3 is a maximum static friction between the shaft of the transfer roller and slide parts of the bearings in which the shaft slidably rotates, and F4 is a dynamic friction between the shaft of the transfer roller and the slide parts of the bearings in which the shaft slidably rotates.

According to one embodiment of the present invention, an image forming apparatus is provided, in which a transfer roller made of metal is prevented from slipping on an endless belt member.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

Figure 1:
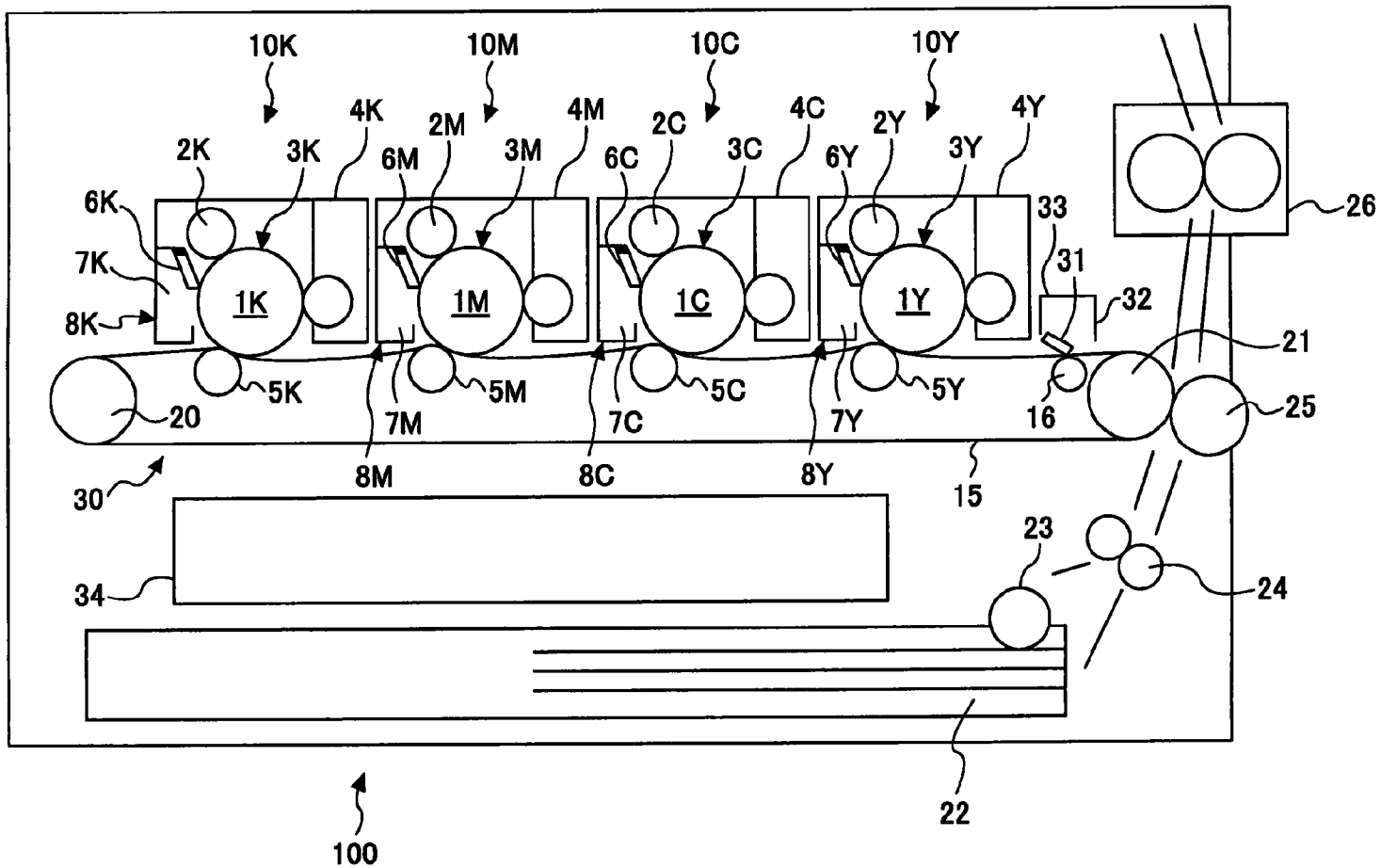
FIG. 1 is a schematic diagram illustrating relevant parts of a printer according to an embodiment of the present invention.

FIG. 1 is a schematic diagram of an example of a printer 100 according to an embodiment of the present invention. The printer 100 is an electrophotographic tandem-type image forming apparatus employing the intermediate transfer method, including four photoconductive drums as image carriers.

The printer 100 includes four process cartridges 10Y, 10M, 10C, and 10K provided vertically above an intermediate transfer belt 15. The process cartridges 10Y, 10M, 10C, and 10K are for forming toner image of yellow, magenta, cyan, and black (hereinafter, "Y, M, C, and K"), respectively. The process cartridges 10Y, 10M, 10C, and 10K use toner in different colors of Y, M, C, and K as the image forming substances, but otherwise have the same configuration. When there is no toner remaining in the developing device, or when components included in the process cartridge 10 become life-expired, the process cartridge 10 is replaced with a new one. The process cartridges 10 include photoconductive drums 1Y, 1M, 1C, and 1K. The letters Y, M, C, and K accompanying the reference numerals denote yellow, magenta, cyan, and black, respectively. The photoconductive drums 1Y, 1M, 1C, and 1K are disposed such that their rotational shafts are directed in the horizontal direction which is the direction extending between the front and back of the apparatus (direction of the normal line of the page on which FIG. 1 is illustrated). The rotational shafts are disposed on the same horizontal plane, and parallel to each other.

Chargers 2Y, 2M, 2C, and 2K serving as charging units are provided near the photoconductive drums 1Y, 1M, 1C, and 1K, respectively, for uniformly charging the surface of the corresponding photoconductive drum. Each of the chargers 2Y, 2M, 2C, and 2K is a contact-type charging unit in which a charging roller charges the photoconductive drum while being in contact with the photoconductive drum and being rotated by the photoconductive drum. Alternatively, a non-contact-type charging unit may be used.

An exposing device (not shown) serving as a latent image forming unit is disposed vertically above the photoconductive drums 1Y, 1M, 1C, and 1K. The exposing device radiates light beams 3Y, 3M, 3C, and 3K corresponding to image information onto the photoconductive drums 1Y, 1M, 1C, and 1K, respectively. An electrostatic latent image of each of the colors is formed on the corresponding photoconductive drum. The exposing device may be a laser beam scanner which includes a laser diode.

Vertically below the process cartridges 10Y, 10M, 10C, and 10K, there is provided a transfer unit 30 which is a transfer belt unit including the intermediate transfer belt 15 which is an endless belt member. The transfer unit 30 includes elements other than the intermediate transfer belt 15, such as a tension roller 20, four primary transfer rollers 5Y, 5M, 5C, and 5K, a secondary transfer opposing roller 21, and a belt cleaning device 33. The transfer unit 30 is detachably attached to the main body of the printer 100, so that the consumable parts can be replaced all at once.

Developing units 4Y, 4M, 4C, and 4K are provided near the photoconductive drums 1Y, 1M, 1C, and 1K, respectively, for developing the electrostatic latent image formed on the corresponding photoconductive drum. A predetermined developing bias is applied from a high voltage power source (not shown) onto developing rollers serving as developer carriers in the developing units 4Y, 4M, 4C, and 4K. Accordingly, the toner included in the developer that is carried on each developing roller moves onto the electrostatic latent image on the corresponding photoconductive drum 1Y, 1M, 1C, and 1K, and the toner adheres to the electrostatic latent image. As a result, toner images corresponding to the electrostatic latent images are formed on the photoconductive drums 1Y, 1M, 1C, and 1K.

The toner images of the respective colors on the photoconductive drums 1Y, 1M, 1C, and 1K which have been formed by the developing process performed by the developing units 4Y, 4M, 4C, and 4K, are transferred and superposed onto the intermediate transfer belt 15 which is an intermediate transfer body, by a primary transfer process. The intermediate transfer belt 15 is wound around plural tension rollers such as the secondary transfer opposing roller 21 serving as a secondary transfer unit, the primary transfer rollers 5Y, 5M, 5C, and 5K serving as primary transfer units, and the tension roller 20. In the present embodiment, a rotation driving force from a driving source (not shown) serving as a driving unit is transmitted to the secondary transfer opposing roller 21. As the secondary transfer opposing roller 21 is rotated by this rotation driving force, the intermediate transfer belt 15 moves in a counterclockwise direction in FIG. 1. That is, in the present embodiment, the secondary transfer opposing roller 21 serves as the driving roller of the intermediate transfer belt 15. Any other tension roller may be used as the driving roller. Furthermore, there is also provided a belt cleaning device 33 and a belt cleaning opposing roller 16 made of metal facing the belt cleaning device 33. Each of the rollers around which the intermediate transfer belt 15 is wound is supported by side plates (not shown) of the transfer unit 30 at both ends in the direction of its shaft.

The secondary transfer opposing roller 21 serving as a driving roller can be a polyurethane rubber roller or a thin film coating roller. In the present embodiment, a urethane coating roller is used because the diameter size does not change significantly due to temperature variations.

Figure 2:
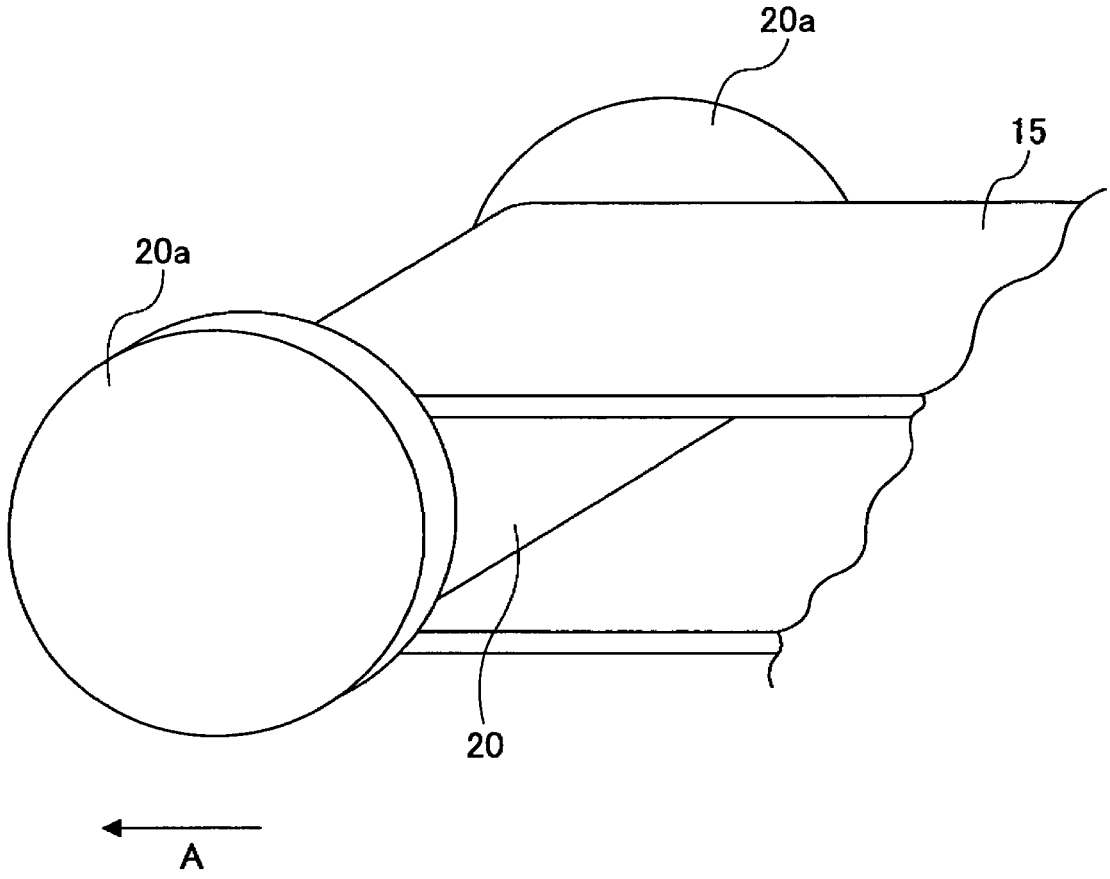
FIG. 2 is a schematic enlarged view of the area around a tension roller of a transfer unit.

FIG. 2 is an enlarged view of the area around the tension roller 20 of the transfer unit 30. The tension roller 20 is made of aluminium and has a pipe shape of ϕ 20 mm. Collars 20*a* of ϕ 24 mm are inserted in both ends of the tension roller 20. The collars 20*a* are restriction members for preventing the intermediate transfer belt 15 from moving along the direction of the shaft of the tension roller 20, so that the intermediate transfer belt 15 is prevented from meandering.

In the present embodiment, the tension roller 20 is provided with restriction members; however, the secondary transfer opposing roller 21 and other tension rollers may also be provided with restriction members.

As for the material forming the intermediate transfer belt 15, a resin-film type endless belt can be used, in which a conductive material such as carbon black is dispersed in PVDF (polyvinylidene fluoride), ETFE (ethylene/tetrafluoroethylene copolymer), PI (polyimide), PC (polycarbonate), and TPE (thermoplastic elastomer). In the present embodiment, a belt having a thickness of 50 μm to 200 μm is used, which has a single layer formed by adding carbon black to TPE having a belt tensile elastic modulus of 1000 MPa to 2000 MPa (tensile elastic modulus: measured in conformity with ISO R1184-1970; specimen: width 15 mm, length 150 mm; tensile speed: 1 mm/min; inter-gripper distance: 100 mm).

As for the resistance of the intermediate transfer belt 15, the volume resistivity is preferably in a range of $10^8$ Ω·cm to $10^{11}$ Ω·cm, and the surface resistivity is preferably in a range of $10^8$ Ω/square to $10^{11}$ Ω/square in an environment of 23° C. and 50% RH (both measured with HirestaUP MCP-HT450 manufactured by Mitsubishi Chemical Corporation, applied voltage 500 V, applied time 10 seconds), for example. If the volume resistivity and the surface resistivity exceed these ranges, it may be necessary to increase the transfer bias, which leads to increased cost in the power source. Furthermore, because the intermediate transfer belt 15 is charged, a measure such as increasing the set voltage value may be required on a downstream side of imaging. Therefore, a single power source may be insufficient as the power source for applying the voltage to the primary transfer member. This is because the charging potential of the intermediate transfer belt 15 increases due to application of the transfer bias, and self-discharge becomes difficult. As a measure against this disadvantage, a discharging mechanism for discharging the intermediate transfer belt 15 may be employed, which leads to a cost increase. On the other hand, if the volume resistivity and the surface resistivity fall below the above range, the charging potential of the intermediate transfer belt 15 would quickly attenuate, which would be advantageous for discharging by self-discharge. However, because the transfer current flowing at the time of transfer would increasingly flow in a surface direction, the toner may scatter. Accordingly, the volume resistivity and the surface resistivity of the intermediate transfer belt 15 are preferably in the above-described range.

It is advantageous to use TPE as the material for the intermediate transfer belt 15 in that a balance between the surface resistivity and the volume resistivity as the electrical resistance can be easily adjusted, while satisfying the range of the belt tensile elastic modulus. Because the surface resistivity and the volume resistivity can be adjusted to a desired balance, the transfer can be performed in a favorable manner. Furthermore, the adjustment can be performed relatively easily, and therefore costs can be reduced.

Metal rollers can be used as the primary transfer members facing the photoconductive drums 1Y, 1M, 1C, and 1K with the intermediate transfer belt 15 disposed therebetween. The primary transfer rollers 5Y, 5M, 5C, and 5K are in offset arrangements relative to the photoconductive drums 1Y, 1M, 1C, and 1K with a consistent distance vertically upwards and in the moving direction of the intermediate transfer belt 15. A transfer electric field is formed between the intermediate transfer belt 15 and each of the photoconductive drums 1Y, 1M, 1C, and 1K by commonly applying a predetermined primary transfer bias to the primary transfer rollers 5Y, 5M, 5C, and 5K from a primary transfer power source (not shown), so that the toner image on the photoconductor is electrostatically transferred to the intermediate transfer belt 15.

Photoconductor cleaning devices 8Y, 8M, 8C, and 8K serve as image carrier cleaning units for removing residual toner remaining on the corresponding photoconductive drum after the primary transfer process. The photoconductor cleaning devices 8Y, 8M, 8C, and 8K are provided around the corresponding photoconductive drums 1Y, 1M, 1C, and 1K. The photoconductor cleaning devices 8Y, 8M, 8C, and 8K include cleaning blades 6Y, 6M, 6C, and 6K as removing members and photoconductor waste toner collecting units 7Y, 7M, 7C, and 7K, respectively. Each of the cleaning blades 6Y, 6M, 6C, and 6K abuts the surface of each photoconductor to scrape off and remove the residual toner on the surface of the photoconductive drum. The residual toner having been removed by the cleaning blades 6Y, 6M, 6C, and 6K is collected by the photoconductor waste toner collecting units 7Y, 7M, 7C, and 7K.

The toner image transferred onto the intermediate transfer belt 15 is then transferred onto a transfer sheet 22 by a secondary transfer process. The transfer sheet 22 is a recording medium conveyed to a secondary transfer area. The secondary transfer area is located between the portion where the belt is wound around the secondary transfer opposing roller 21, and a secondary transfer roller 25. The toner image on the intermediate transfer belt 15 is electrostatically transferred onto a recording material by applying a predetermined secondary transfer bias to the secondary transfer roller 25 from a high voltage power source (not shown).

The secondary transfer roller 25 is formed by covering a metal core made of SUS or the like with an elastic layer such as urethane processed to have a resistance of $10^6$ to $10^{10}\Omega$ with a conductive material. As the materials, an ion conductive roller (urethane+carbon dispersion, NBR, hydrin), an electron conductive roller (EPDM), and the like can be used. In the present embodiment, a foam roller having an Asker C hardness (according to Asker hardness testers manufactured by Kobunshi Keiki Co., Ltd., Japan) of 35° to 70° is used as the urethane roller.

When the resistance of the secondary transfer roller 25 exceeds the above range, it becomes hard to flow for the transfer current, and therefore a high voltage may need to be applied for obtaining desired transferability, which leads to increased power cost. As a result of applying high voltage, discharge occurs in the gap in front of or behind the secondary transfer nip. Consequently, white spots appear on a halftone image due to the discharge. This phenomenon is noticeable in a low temperature and low humidity environment (for example, 10° C., 15% RH).

On the other hand, when the resistance of the secondary transfer roller 25 falls below the above range, it is difficult to maintain excellent transferability both in an image area where toner images of plural colors are superposed on the same image, and in a monochrome image area. The reason is that since the resistance of the secondary transfer roller 25 is low, if the secondary transfer bias were set to a relatively low voltage with which an optimum transfer current can be obtained for the monochrome image area, a sufficient transfer current would not be obtained for the color image area. On the other hand, if the secondary transfer bias were set to a relatively high voltage with which an optimum transfer current can be obtained for the color image area, an excessive transfer current would flow to the monochrome image area, thereby decreasing transfer efficiency.

The resistance of the secondary transfer roller 25 is calculated from a current value flowing at the time of applying a voltage of 1000 V between the core and a conductive metal plate in a state with a load of 4.9 N being respectively applied to the opposite ends of the core (in total, 9.8 N at both ends), by installing the secondary transfer roller 25 on the conductive metal plate.

The transfer sheet 22 is fed by a sheet feed conveying roller 23 and a resist roller pair 24, matched with the timing when the leading edge of the toner image on the surface of the intermediate transfer belt 15 reaches the secondary transfer position, and the toner image on the intermediate transfer belt 15 is transferred onto the transfer sheet 22 by applying the predetermined secondary transfer bias from the high voltage power source (not shown). The transfer sheet 22 is separated from the intermediate transfer belt 15 due to a curvature factor of the secondary transfer opposing roller 21, and the transfer sheet 22 is ejected after the toner image transferred onto the transfer sheet 22 is fixed by a fixing device 26 serving as a fixing unit.

The belt cleaning device 33 serving as an intermediate transfer member cleaning unit for removing the residual toner remaining on the intermediate transfer belt 15 after the secondary transfer, is arranged at a position facing the belt cleaning opposing roller 16 with the intermediate transfer belt 15 disposed therebetween. The belt cleaning device 33 includes a cleaning blade 31 as a removing member and a transfer belt waste toner collecting unit 32. The cleaning blade 31, which is made of urethane rubber having a thickness of 1.5 mm through 3 mm, abuts against the surface of the intermediate transfer belt 15, and scrapes off and removes the residual toner on the surface of the intermediate transfer belt 15. The residual toner removed by the cleaning blade 31 is collected by the transfer belt waste toner collecting unit 32, and is carried to a waste toner container 34 via a toner carrier path (not shown) where the residual toner is accumulated. The portion of the intermediate transfer belt 15 corresponding to the cleaning nip and/or the edge of the cleaning blade 31 has a lubricant, toner, or zinc stearate applied thereon at the time of assembly. This prevents the blade from rolling up at the cleaning nip, and also forms a dam layer at the cleaning nip, so that the cleaning performance is enhanced.

Furthermore, although not shown in the diagram, a toner mark sensor (TM sensor) is provided at a position facing the intermediate transfer belt 15. Accordingly, a specular reflection type sensor or a diffusion type sensor is used for measuring the toner image density and the color positions on the intermediate transfer belt 15, to adjust the image density and to match the positions of the colors.

In the present embodiment, there are various modes which can be specified by an operation unit, including a monochrome mode for forming an image of any one color of yellow, magenta, cyan, and black; a two-color mode for superposing any two colors of yellow, magenta, cyan, and black to form an image of two colors; a three-color mode for superposing any three colors of yellow, magenta, cyan, and black to form an image of three colors; and a full color mode for forming the four-color image described above.

The transfer unit 30 in the present embodiment supports the intermediate transfer belt 15, the tension roller 20, the primary transfer rollers 5Y, 5M, 5C, and 5K, the secondary transfer opposing roller 21, and the belt cleaning device 33, and is detachably attached to the printer 100, so that consumable parts can be replaced at once. The intermediate transfer belt 15 moves in a direction indicated by an arrow A (see FIG. 2). The transfer unit 30 can also support the secondary transfer roller 25, if desired.

Figure 3:
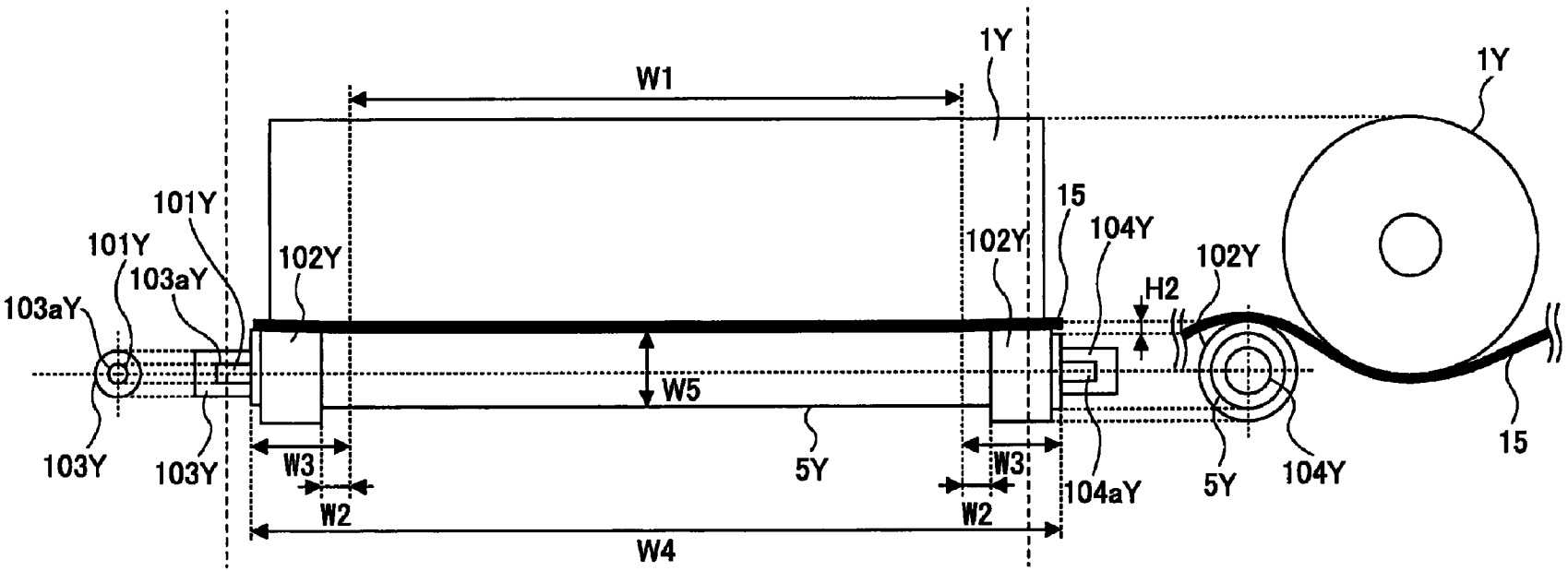
FIG. 3 is a schematic enlarged view of the area around a primary transfer roller of the transfer unit.

FIG. 3 is a schematic enlarged view of the area around the primary transfer roller which is an exemplary transfer roller of the transfer unit. As shown in FIG. 3, the primary transfer roller 5Y is a metal roller having a length of W4=227.4 mm and a diameter of W5=8 mm, and is offset relative to the photoconductive drum 1Y by a consistent distance vertically upwards, in a moving direction of the intermediate transfer belt 15. W1 indicates the image creation range of the photoconductor. The ends of a cylindrical member made of metal are cut by a machining process to form the primary transfer roller 5Y and a shaft 101Y of the primary transfer roller 5Y. One end of the shaft 101Y of the primary transfer roller 5Y is inserted into a shaft insertion part 103*a*Y (slide part) of a bearing 103Y made of conductive resin, so as to be held in the shaft insertion part 103*a*Y in a freely-rotatable manner. The other end of the shaft 101Y is inserted into a shaft insertion part 104*a*Y (slide part) of a bearing 104Y made of non-conductive resin, so as to be held in the shaft insertion part 104*a*Y in a freely-rotatable manner.

A high voltage power source (not shown) is electrically connected to the bearing 103Y made of conductive resin. A primary transfer bias from the high voltage power source is applied to the primary transfer roller 5Y via the bearing 103Y made of conductive resin.

When the intermediate transfer belt 15 rotates, the primary transfer roller 5Y is rotated while sliding within the shaft insertion parts 103*a*Y and 104*a*Y of the bearings 103Y and 104Y. A primary transfer electric field is formed at the primary transfer nip (between the intermediate transfer belt 15 and each photoconductive drum 1) by a primary transfer bias applied to the primary transfer roller 5Y via the bearing 103Y made of conductive resin. Accordingly, the toner image on the photoconductive drum 1Y is transferred to the intermediate transfer belt 15 by a primary transfer process.

The present embodiment has the following configuration to prevent the primary transfer roller 5Y from slipping relative to the intermediate transfer belt 15. That is, the maximum static friction F3 between the shaft 101Y of the primary transfer roller 5Y and the shaft insertion parts 103*a*Y and 104*a*Y in which the shaft 101Y held by the bearings 103Y and 104Y slidably rotate, is smaller than the maximum static friction F1 between the primary transfer roller 5Y and the intermediate transfer belt 15 which is the endless belt member. Furthermore, the dynamic friction F4 between the shaft 101Y of the primary transfer roller 5Y and the shaft insertion parts 103*a*Y and 104*a*Y of the bearings 103Y and 104Y, is smaller than the dynamic friction F2 between the primary transfer roller 5Y and the intermediate transfer belt 15.

The force necessary for causing the primary transfer roller 5Y to start rotating from a stopped state is the maximum static friction F3 between the shaft 101Y of the primary transfer roller 5Y and the shaft insertion parts 103*a*Y and 104*a*Y of the bearings 103Y and 104Y.

The maximum static friction F1 between the primary transfer roller 5Y and the intermediate transfer belt 15 is the maximum force for causing the intermediate transfer belt 15 to start moving while slipping relative to the primary transfer roller 5Y, when the primary transfer roller 5Y is fixed so as not to rotate. That is, the maximum static friction F1 is the maximum force that can be applied by the intermediate transfer belt 15 to the primary transfer roller 5Y in a stopped state, without having the intermediate transfer belt 15 slip relative to the primary transfer roller 5Y. Accordingly, if F1 were higher than F3, the primary transfer roller 5Y in the stopped state would start to be rotated without slipping on the intermediate transfer belt 15.

While the primary transfer roller 5Y is rotating, the dynamic friction F4 is required, which is the dynamic friction between the shaft 101Y of the primary transfer roller 5Y and the shaft insertion parts 103*a*Y and 104*a*Y of the bearings 103Y and 104Y. Accordingly, if the dynamic friction F2 between the primary transfer roller 5Y and the intermediate transfer belt 15 were higher than F4, the primary transfer roller 5Y in a rotating state would continue to be rotated without slipping relative to the intermediate transfer belt 15.

The surface of a metal roller has a low friction coefficient, and therefore the relationships between the above-described frictions would be F1<F3 and F2<F4, which would cause the primary transfer roller 5Y to slip relative to the intermediate transfer belt 15. When the primary transfer roller 5Y slips, the back side of the intermediate transfer belt 15 is scraped, as the intermediate transfer belt 15 is made of a softer material than that of the metal roller. As a result, abrasion powder is generated, which is electrically fused with the surface of the metal roller. If the primary transfer roller 5Y slips relative to the intermediate transfer belt 15 in a state where the abrasion powder is fused with the primary transfer roller 5Y, the abrasion powder may form a film on the primary transfer roller 5Y over time. When such a film is formed, the resistance of the primary transfer roller 5Y increases, such that the primarily transfer electric field becomes insufficient and the transfer efficiency decreases, which leads to degraded image quality over time.

In the present embodiment, both end portions of the primary transfer roller 5Y, which are located outside the image creation range W1 of the photoconductive drum 1Y, are provided with ring-shaped elastic bodies 102Y. The elastic bodies 102Y are adhered or press-fitted to the end portions. The elastic bodies 102Y are made of members having a higher friction coefficient than that of the surface of the metal roller. Specifically, the elastic bodies 102Y have a friction coefficient with which the following can be achieved. That is, the maximum static friction between the elastic bodies 102Y provided at both end portions of a metal roller and the intermediate transfer belt 15 is higher than the maximum static friction F3 between the shaft 101Y of the primary transfer roller 5Y and the shaft insertion parts 103*a*Y and 104*a*Y of the bearings 103Y and 104Y. Furthermore, the dynamic friction between the elastic bodies 102Y at both end portions and the intermediate transfer belt 15 is higher than the dynamic friction F4 between the shaft 101Y of the primary transfer roller 5Y and the shaft insertion parts 103*a*Y and 104*a*Y of the bearings 103Y and 104Y. Accordingly, by providing the elastic bodies 102Y to both end portions of a metal roller, the maximum static friction F1 between the primary transfer roller 5Y and the intermediate transfer belt 15 becomes higher than the maximum static friction F3 between the shaft 101Y of the primary transfer roller 5Y and the shaft insertion parts 103*a*Y and 104*a*Y of the bearings 103Y and 104Y. Furthermore, the dynamic friction F2 between the primary transfer roller 5Y and the intermediate transfer belt 15 becomes higher than the dynamic friction F4 between the shaft 101Y of the primary transfer roller 5Y and the shaft insertion parts 103*a*Y and 104*a*Y of the bearings 103Y and 104Y, so that the primary transfer roller 5Y can be prevented from slipping relative to the intermediate transfer belt 15. The elastic body 102Y may be provided at only one of the end portions of the primary transfer roller 5Y, if desired. Even if the elastic body 102Y is provided at only one of the end portions of the primary transfer roller 5Y, the conditions F1>F3 and F2>F4 would be satisfied, so that the primary transfer roller 5Y can be prevented from slipping relative to the intermediate transfer belt 15.

When the elastic body 102Y is fixed to the primary transfer roller 5Y with an adhesive, the primary transfer roller 5Y can be prevented from slipping by satisfying the above conditions. However, for the purpose of reducing cost, instead of fixing the elastic body 102Y with an adhesive, the following measure can be taken. That is, the inner diameter of the ring-type elastic body 102Y is made smaller than the outer diameter of the primary transfer roller 5Y, and the ring-type elastic body 102Y is press-fitted to the primary transfer roller 5Y. In this case, the ring-type elastic body 102Y needs to be prevented from slipping relative to the primary transfer roller 5Y. That is, the maximum static friction F5 between the ring-type elastic body 102Y and the primary transfer roller 5Y (metal roller) is made higher than the maximum static friction F3 between the shaft 101Y of the primary transfer roller 5Y and the shaft insertion parts 103*a*Y and 104*a*Y of the bearings 103Y and 104Y. Furthermore, the dynamic friction F6 between the elastic body 102Y and the primary transfer roller 5Y is made higher than the dynamic friction F4 between the shaft 101Y of the primary transfer roller 5Y and the shaft insertion parts 103*a*Y and 104*a*Y of the bearings 103Y and 104Y. Accordingly, the elastic body 102Y is prevented from slipping relative to the primary transfer roller 5Y which is a metal roller. Consequently, the primary transfer roller 5Y is prevented from slipping relative to the intermediate transfer belt 15.

Furthermore, the elastic body 102Y preferably satisfies the following conditions.

1. Does not damage/deform the intermediate transfer belt 15 over time.
2. Does not decrease the primary transfer electric field at the edges of the image creation range W1, so that transfer failures are prevented.
3. Is not degraded due to the voltage.
4. Even when the friction coefficient decreases due to foreign matter entering in between the components, the static friction and the dynamic friction between the elastic body 102Y and the intermediate transfer belt 15 are higher than the above-described F3 and F4, respectively.

The elastic body 102Y satisfying the above conditions is preferably a foamed sponge. Examples of materials are foamed polyurethane and foamed EPDM. The elastic body 102Y preferably has an Asker-C hardness of 20° through 50° in the case of foamed polyurethane, and preferably has an Asker-C hardness of 20° in the case of foamed EPDM.

Table 1 shows the results obtained by evaluating foamed polyurethane and foamed EPDM at Asker-C hardness of 10°, 20°, 50°, and 80°. Specifically, evaluations were made as to whether there is deterioration due to current application, durability, and whether F1>F3, F2>F4 is satisfied when foreign matter such as toner enters in between the components. The evaluations were made by incorporating, in the apparatus, primary transfer rollers made of foamed polyurethane and foamed EPDM at Asker-C hardness of 10°, 20°, 50°, and 80°. To evaluate whether the friction coefficient decreases with respect to toner, toner was applied between the elastic body 102Y and the intermediate transfer belt 15, and a durability test was performed by forming images on 100,000 sheets, which corresponds to the operating life of the machine.

TABLE 1

EVALUATION OF MATERIALS OF ELASTIC BODY

| | MATERIAL | | | | | | | |
|---|---|---|---|---|---|---|---|---|
| | FOAMED EPDM | | | | FOAMED POLYURETHANE | | | |
| EVALUATION ITEMS | ASKER-C HARDNESS 80° C. | ASKER-C HARDNESS 50° C. | ASKER-C HARDNESS 20° C. | ASKER-C HARDNESS 10° C. | ASKER-C HARDNESS 80° C. | ASKER-C HARDNESS 50° C. | ASKER-C HARDNESS 20° C. | ASKER-C HARDNESS 10° C. |
| DETERIORATION DUE TO CURRENT | ○ DID NOT DETERIORATE | ○ DID NOT DETERIORATE | ○ DID NOT DETERIORATE | ○ DID NOT DETERIORATE | ○ DID NOT DETERIORATE | ○ DID NOT DETERIORATE | ○ DID NOT DETERIORATE | ○ DID NOT DETERIORATE |
| DURABILITY OF ELASTIC BODY (DAMAGES, ETC.) ※1 | ○ WAS NOT DAMAGED | ○ WAS NOT DAMAGED | ○ WAS NOT DAMAGED | X WAS DAMAGED | ○ WAS NOT DAMAGED | ○ WAS NOT DAMAGED | ○ WAS NOT DAMAGED | X WAS DAMAGED |
| DECREASE OF μ WHEN TONER ENTERS BETWEEN COMPONENTS ※2 | X WAS NOT SATISFIED | X WAS NOT SATISFIED | ○ SATISFIED | ○ SATISFIED | X WAS NOT SATISFIED | ○ SATISFIED | ○ SATISFIED | ○ SATISFIED |

※1 PERFORMED DURABILITY TEST FOR 100 K SHEETS WHICH IS OPERATING LIFE OF MACHINE

※2 CONFIRMED WHETHER F1 >F3, F2 >F4 IS SATISFIED WHEN TONER IS SPRINKLED OVER ELASTIC BODY, TONER HAS ENTERED BETWEEN COMPONENTS, AND μ HAS DECREASED

As shown in Table 1, when foamed EPDM having an Asker-C hardness of 20° and foamed polyurethane having an Asker-C hardness of 20° and 50° were used as the elastic body 102Y, favorable results were obtained, i.e., after the durability test, no deformities or damages were caused by deterioration due to current application, and F1>F3, F2>F4 was satisfied even when the friction coefficient decreased with toner in between the components. Thus, the above conditions 1 through 4 can be satisfied and favorable properties can be attained when foamed polyurethane having an Asker-C hardness of 20° through 50° or foamed EPDM having an Asker-C hardness of 20° is used as the elastic body 102Y according to the present embodiment.

Next, descriptions are given of the position and the size of the elastic body 102Y.

The position and the size of the elastic body 102Y are determined preferably such that when the primary transfer roller 5Y is in an offset arrangement, there is no gap between the intermediate transfer belt 15 and the primary transfer roller 5Y at the edges of the image creation range W1 of the photoconductive drum 1Y. If there are gaps between the intermediate transfer belt 15 and the primary transfer roller 5Y at the edges of the image creation range W1 of the photoconductive drum 1Y, the primary transfer electric fields at the edges of the image creation range W1 may decrease, which may lead to transfer failures at the edges of the image.

Table 2 shows results obtained by evaluating images formed under different conditions, i.e., the length W2 between the image creation range W1 and the elastic body 102Y was varied and the height H2 of the elastic body 102Y was varied with the primary transfer roller 5Y being in an offset arrangement.

TABLE 2

WHETHER THERE ARE DEFECTS AT EDGES OF IMAGE

| | | W2 | | | | |
|---|---|---|---|---|---|---|
| | | 6 mm | 8 mm | 10 mm | 12 mm | 14 mm |
| H2 | 0.5 mm | ○ | ○ | ○ | ○ | ○ |
| | 1.0 mm | X | ○ | ○ | ○ | ○ |
| | 1.5 mm | X | X | ○ | ○ | ○ |
| | 2.0 mm | X | X | X | X | ○ |
| | 2.5 mm | X | X | X | X | ○ |

X IMAGE DEFECTS PRESENT
○ NO IMAGE DEFECTS

With reference to Table 2, for images with evaluations of "x", which means that there were defects at the edges of the image, it was found that a gap was formed between the intermediate transfer belt 15 and the primary transfer roller 5Y at the edges of the image creation range W1 on the photoconductive drum 1Y. Meanwhile, for images with evaluations of "o", which means that there were no defects at the edges of the image, it was found that there was no gap between the intermediate transfer belt 15 and the primary transfer roller 5Y at the edges of the image creation range W1 on the photoconductive drum 1Y.

Table 3 shows results indicating the condition of the edges of the intermediate transfer belt 15 obtained after performing durability tests for 100,000 sheets. The length W2 and the height H2 were changed for each of the tests. The evaluation of "x" means that the edges of the intermediate transfer belt 15 had cracks. The evaluation of "Δ" means that the edges of the intermediate transfer belt 15 deformed even slightly into a wavy shape. The evaluation of "o" means that the edges of the intermediate transfer belt 15 had no abnormalities.

TABLE 3

WHETHER EDGES OF TRANSFER BELT ARE DEFORMED OR CRACKED

| | | W2 | | | | |
|---|---|---|---|---|---|---|
| | | 6 mm | 8 mm | 10 mm | 12 mm | 14 mm |
| H2 | 0.5 mm | ○ | ○ | ○ | ○ | ○ |
| | 1.0 mm | ○ | ○ | ○ | Δ | Δ |
| | 1.5 mm | Δ | Δ | Δ | Δ | X |
| | 2.0 mm | Δ | Δ | Δ | X | X |
| | 2.5 mm | X | X | X | X | X |

X CRACKED AT EDGES
Δ EDGES DEFORMED
○ NO ABNORMALITIES

As shown in Table 3, as the values of W2 and H2 increase, the load applied to the intermediate transfer belt 15 increases, thereby causing waves and cracks to form at the edges of the intermediate transfer belt 15.

Based on the results shown in Tables 2 and 3, W2 is set at 10 mm and the height H2 is set at 1 mm in the present embodiment. The width of the elastic body 102Y preferably satisfies $$W2+\text{width of elastic body} \leqq W3$$

where W3 is the length between the edge of the image creation range W1 on the photoconductive drum 1Y and the end of the primary transfer roller 5Y. If the width of the elastic body 102Y were too short, the static friction and the dynamic friction of the elastic bodies provided at both ends would be lower than F3, which may cause the primary transfer roller 5Y to slip relative to the intermediate transfer belt 15. In the present embodiment, the sizes are set at W2=10 mm and W3=18 mm, and therefore the width of the elastic body 102Y is set at 5 mm so that the static friction and the dynamic friction of the elastic bodies provided at both ends would not be lower than F3.

Table 4 shows the evaluations for transfer efficiency and residual images. Specifically, durability tests for 100,000 sheets were performed with a primary transfer roller (metal roller) with elastic bodies provided at its ends and a primary transfer roller without any elastic bodies at its ends. At every 25,000th sheet after starting the durability test, the transfer efficiency and residual images were confirmed.

As for the transfer efficiency, "x" was given when the transfer efficiency was less than 80%, "Δ" was given when the transfer efficiency was more than or equal to 80% and less than 90%, and "o" was given when the transfer efficiency was more than or equal to 90%. When the transfer efficiency dropped below 80%, the image density would not appear and the degraded image quality would be visibly perceivable, and therefore "x" was given when the transfer efficiency was less than 80%. When the transfer efficiency is more than or equal to 80% and less than 90%, degraded image quality and decreased density cannot be confirmed unless carefully observed, and therefore "Δ" was given. When the transfer efficiency was more than or equal to 90%, the image density appears and the image quality is not degraded, and therefore "o" was given.

As for the residual image level, "poor" was given when the residual image was visibly perceivable, and "good" was given when the residual image was not visibly perceivable unless carefully observed.

TABLE 4

EVALUATION OF EMBODIMENT ACCORDING TO PRESENT INVENTION

| ITEM FOR EVALUATING | NO. OF SHEETS | STATE OF METAL ROLLER | |
|---|---|---|---|
| IMAGE QUALITY | (K = ×1000 SHEETS) | WITHOUT ELASTIC BODY | WITH ELASTIC BODY |
| PRIMARY TRANSFER EFFICIENCY | 0K | ○ | ○ |
| | 25K | ○ | ○ |
| | 50K | Δ | ○ |
| | 75K | X | ○ |
| | 100K | X | ○ |

TABLE 4-continued

| EVALUATION OF EMBODIMENT ACCORDING TO PRESENT INVENTION | | | |
|---|---|---|---|
| ITEM FOR EVALUATING | NO. OF SHEETS | STATE OF METAL ROLLER | |
| IMAGE QUALITY | (K = ×1000 SHEETS) | WITHOUT ELASTIC BODY | WITH ELASTIC BODY |
| RESIDUAL IMAGE LEVEL | 0K | GOOD (NOT VISIBLY PERCEIVABLE) | GOOD (NOT VISIBLY PERCEIVABLE) |
| | 25K | GOOD (NOT VISIBLY PERCEIVABLE) | GOOD (NOT VISIBLY PERCEIVABLE) |
| | 50K | POOR (EASILY VISIBLY PERCEIVABLE) | GOOD (NOT VISIBLY PERCEIVABLE) |
| | 75K | POOR (EASILY VISIBLY PERCEIVABLE) | GOOD (NOT VISIBLY PERCEIVABLE) |
| | 100K | POOR (EASILY VISIBLY PERCEIVABLE) | GOOD (NOT VISIBLY PERCEIVABLE) |

X . . . TRANSFER EFFICIENCY LESS THAN 80%
Δ . . . TRANSFER EFFICIENCY MORE THAN OR EQUAL TO 80% AND LESS THAN 90%
○ . . . TRANSFER EFFICIENCY MORE THAN OR EQUAL TO 90%

As shown in Table 4, with the primary transfer roller without elastic bodies, the transfer efficiency declined at 50,000 sheets, and the transfer efficiency dropped below 80% at 75,000 sheets, and the image quality was apparently degraded. Meanwhile, with the primary transfer roller provided with elastic bodies, the transfer efficiency was maintained at more than or equal to 90% even after completing the durability test of 100,000 sheets, thereby maintaining a favorable transfer efficiency from the beginning to the end of the test.

The residual image level was "poor" for the primary transfer roller without the elastic bodies, as a residual image was easily perceivable at 50,000 sheets. Meanwhile, the residual image level for the primary transfer roller provided with the elastic bodies was "good" even after completing the durability test of 100,000 sheets, thereby maintaining a favorable residual image level from the beginning to the end of the test.

It is considered that the primary transfer roller provided with the elastic bodies was able to maintain a favorable transfer efficiency and a favorable residual image level over time, because the primary transfer roller was prevented from slipping, the foreign matter adhering to the surface of the primary transfer roller was prevented from forming a film, and the resistance of the primary transfer roller was prevented from increasing over time. Meanwhile, it is considered that the transfer efficiency and the residual image level declined in the case of the primary transfer roller without the elastic bodies because the primary transfer roller slipped, the foreign matter adhering to the surface of the primary transfer roller formed a film, and the resistance of the primary transfer roller increased over time.

In the present embodiment, a lubricant can be applied to the shaft insertion parts 103*a*Y and 104*a*Y where the shaft 101Y of the primary transfer roller 5Y bears against the bearings 103Y and 104Y. By applying a lubricant to the shaft insertion parts 103*a*Y and 104*a*Y, F3 and F4 can be reduced, and the safety margin of F1, F2, F5, and F6 can be increased. In the present embodiment, the primary transfer bias from a high-voltage power source is applied to the primary transfer roller 5Y via the bearing 103Y made of conductive resin. Therefore, a conductive lubricant is preferably applied to the shaft insertion part 103*a*Y of the bearing 103Y made of conductive resin. By applying a conductive lubricant to the shaft insertion part 103*a*Y of the bearing 103Y made of conductive resin, it is possible to prevent electrical loss between the bearing 103Y and the primary transfer roller 5Y, so that the voltage of the high-voltage power source can be maintained at a low level.

In the above description, the elastic bodies 102Y are provided at the end portions of the primary transfer roller 5Y which is a metal roller; however, the components are not limited to elastic bodies. For example, sheet-like members having higher friction coefficients than the surface of the primary transfer roller 5Y which is a metal roller can be provided at the end portions. More specifically, each sheet member adhered to the end portions of the primary transfer roller may have a friction coefficient that makes the static friction and the dynamic friction between the sheet member and the intermediate transfer belt 15 higher than the static friction F3 and the dynamic friction F4 between the shaft insertion part of the bearing and the shaft, respectively. Furthermore, the thickness of the sheet member can be appropriately determined based on the information in Tables 2 and 3. That is, when the length W2 between the image creation range W1 and the sheet member is 10 mm, the thickness of the sheet member is to be less than or equal to 1.0 mm so as to prevent image deficiencies and abnormalities at the edges of the intermediate transfer belt.

A blast process can be performed on the surface of the primary transfer roller 5Y which is a metal roller to increase the friction coefficient of the surface of the primary transfer roller 5Y so that F1>F3, F2>F4 is satisfied.

Next, a description is given of an image forming apparatus according to modification 1 of the present embodiment.

[Modification 1]

Figure 4:
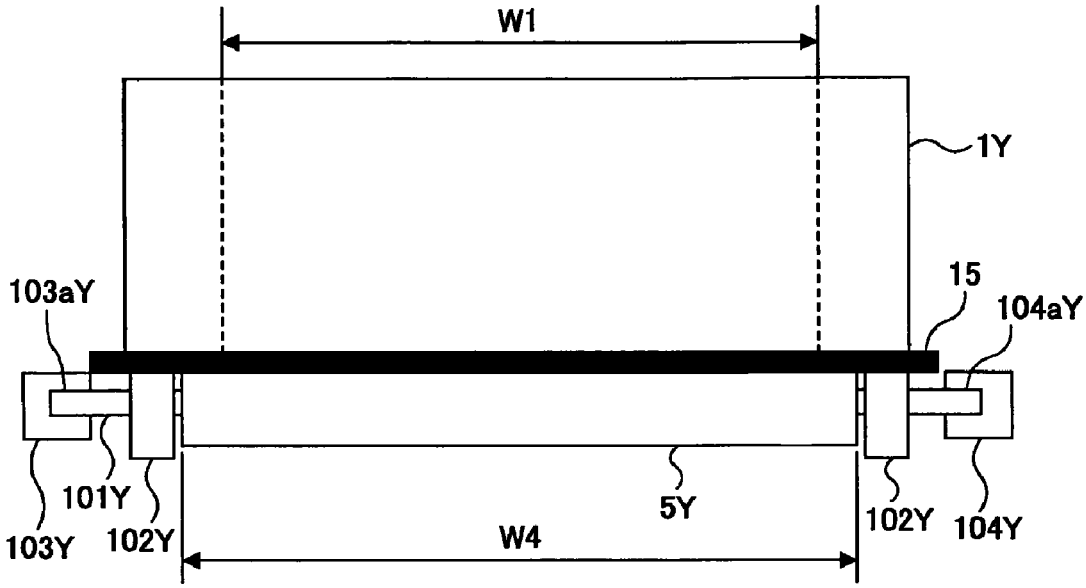
FIG. 4 is a schematic enlarged view of the area around the primary transfer roller in a transfer unit according to modification 1.
Figure 5A:
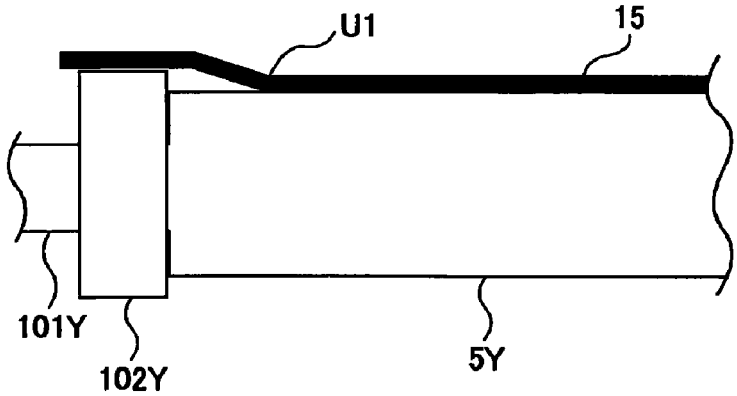
FIG. 5A is an enlarged view of the part where the intermediate transfer belt is contacting the primary transfer roller when Fs>Ft.

FIG. 4 is a schematic enlarged view of the area around the primary transfer roller which is the transfer roller in the image forming apparatus according to modification 1. In the image forming apparatus according to modification 1, the elastic bodies 102Y are provided on the shaft 101Y of the primary transfer roller 5Y. In this case, the length W4 of the primary transfer roller 5Y is shorter than that shown in FIG. 3. The elastic bodies 102Y are preferably made of a foamed sponge such as foamed polyurethane and foamed EPDM, as described above. The outer diameter of each elastic body 102Y is larger than the diameter of the metal roller, and the elastic body 102Y is configured to be compressed by the tension of the intermediate transfer belt 15. By compressing the elastic body 102Y, the normal force between the intermediate transfer belt 15 and the elastic body 102Y can be increased. Thus, the friction between the intermediate transfer belt 15 and the elastic body 102Y can be increased. Accordingly, the primary transfer roller 5Y which is a metal roller can be prevented from slipping relative to the intermediate transfer belt 15. Thus, it is possible to prevent abrasion powder from being generated as a result of the primary transfer roller 5Y slipping on and scraping the back side of the intermediate transfer belt 15. In this regard, the amount of abrasion powder can be reduced more than the case where the elastic body and the primary transfer roller have the same diameter. The elastic body 102Y is preferably compressed by the tension of the intermediate transfer belt 15 so that it is compressed to the diameter of the primary transfer roller 5Y (in a manner so that the intermediate transfer belt 15 is tangent to the diameter of the primary transfer roller 5Y). If the elastic body 102Y protrudes from the primary transfer roller 5Y (in FIG. 5A, the diameter is larger than that of the primary transfer roller 5Y), the gap between the intermediate transfer belt 15 and the primary transfer roller 5Y (top left part of FIG. 5A) would extend axially into the image creation range W1. Accordingly, the primary transfer electric field at the edges of the image creation range W1 would decrease, which leads to transfer failures at both edges of the image. If the apparatus is not operated for a long period of time, a part of the intermediate transfer belt 15 located at the primary transfer roller 5Y may become lifted up as shown in FIG. 5A. Accordingly, the part U1 at the edge where the intermediate transfer belt 15 starts to lift up may be included in the image creation range W1. If this part U1 is included in the image creation range W1, the part U1 may be separated from the photoconductive drum 1Y where the intermediate transfer belt 15 is supposed to be contacting the photoconductive drum 1Y. As a result, an image with blank portions may be created. Furthermore, if the elastic body 102Y protruded from the primary transfer roller 5Y, waves and cracks would likely be formed at the edges of the intermediate transfer belt 15, which decreases the safety margin in the durability of the intermediate transfer belt 15.

Figure 5B:
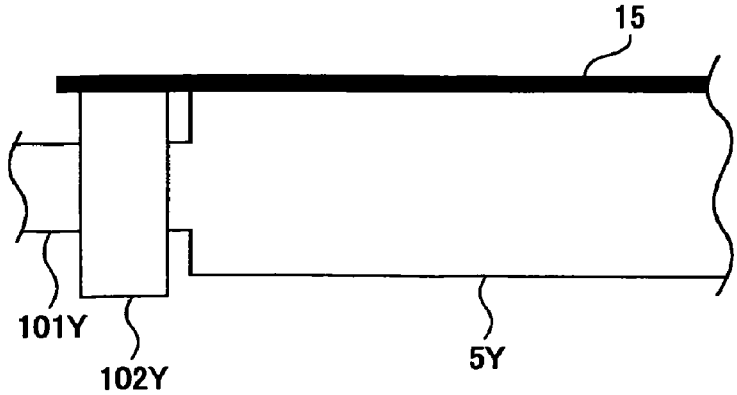
FIG. 5B is an enlarged view of the part where the intermediate transfer belt is contacting the primary transfer roller when Fs<Ft.
Figure 6:
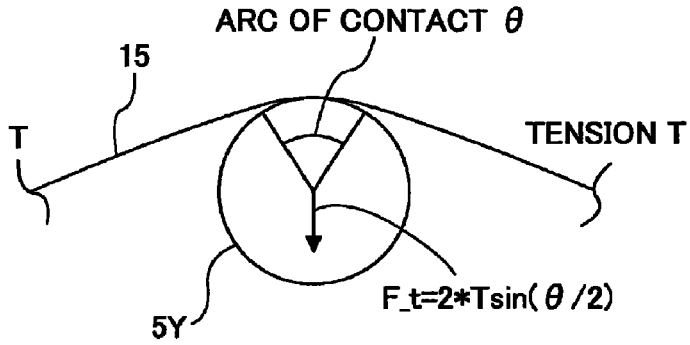
FIG. 6 is a diagram for describing a force Ft which an elastic body receives from the intermediate transfer belt.

Thus, in the present embodiment, the force Ft which the elastic body 102Y receives from the intermediate transfer belt 15 is larger than the force Fs required for compressing the elastic body 102Y to the diameter of the primary transfer roller 5Y which is a metal roller. As illustrated in FIG. 6, the force Ft which the elastic body 102Y receives from the intermediate transfer belt 15 can be expressed by $Ft=2T\sin(\theta/2)$, where T is the tension of the intermediate transfer belt 15, and θ is the arc of contact between the primary transfer roller 5Y and the intermediate transfer belt 15. By making the force Ft which the elastic body 102Y receives from the intermediate transfer belt 15 larger than the force Fs required for compressing the elastic body 102Y to the diameter of the primary transfer roller 5Y, the elastic body 102Y can be compressed to the diameter of the primary transfer roller 5Y as shown in FIG. 5B. Accordingly, a gap can be prevented from being formed between the intermediate transfer belt 15 and the primary transfer roller 5Y. Furthermore, the edges of the intermediate transfer belt 15 can be prevented from lifting up. Therefore, the intermediate transfer belt is not separated from the photoconductive drum at the part where it is contacting the photoconductive drum.

The material of the intermediate transfer belt 15, the hardness of the elastic bodies 102Y, the arc of contact θ, and the diameter of the elastic body 102Y are determined so as to satisfy $Ft>Fs$.

As described in modification 1, elastic bodies are provided on the shaft 101Y of the transfer roller and compressed by the intermediate transfer belt 15 in such a manner as to be tangent to the diameter of the primary transfer roller. Therefore, with modification 1, the edges of the intermediate transfer belt are more reliably prevented from lifting up than the case of providing the elastic bodies at the end portions (not directly on the shaft as in modification 1) of the primary transfer roller. Additionally, with modification 1, the normal force can be increased so that the primary transfer roller is more reliably prevented from slipping than the case of providing the elastic bodies at the end portions (not directly on the shaft as in modification 1) of the primary transfer roller.

The elastic bodies can be compressed in such a manner as to satisfy a relationship between W2 and H2 with which favorable images can be formed and the transfer belt can have excellent durability as indicated in Tables 3 and 4. That is, for example, when the length W2 between the image creation range W1 and the elastic body is 8 mm, the elastic body 102Y is to be compressed such that the height H2 of the elastic body 102Y from the surface of the primary transfer roller is less than or equal to 1.0 mm. In this case, the force Ft which the elastic body 102Y receives from the intermediate transfer belt 15 is to be stronger than or equal to the force required for compressing the elastic body to protrude from the surface of the primary transfer roller by 1.0 mm. Also in the case of providing the elastic bodies on the shaft of the primary transfer roller, the elastic bodies can be compressed in such a manner as to satisfy the relationship between W2 and H2 with which favorable images can be formed and the intermediate transfer belt can have excellent durability as indicated in Tables 3 and 4.

Figure 7:
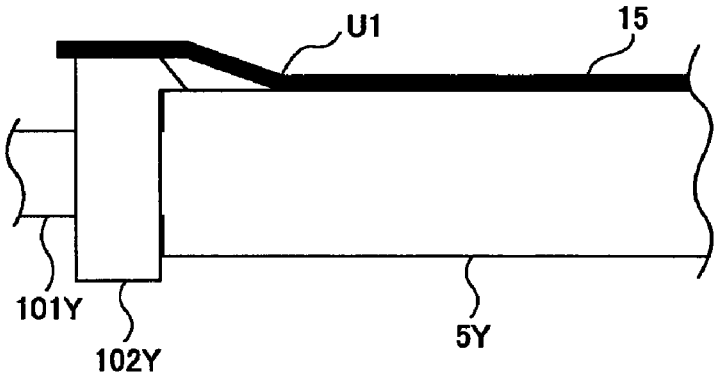
FIG. 7 is a diagram illustrating a case where the elastic body has run onto an end portion of the primary transfer roller.

In the image forming apparatus according to modification 1 in which the elastic bodies are provided on the shaft of the primary transfer roller, the width of the elastic body 102Y is preferably approximately 5 mm. If the width is approximately 5 mm, the static friction F1 and the dynamic friction F2 between the intermediate transfer belt 15 and the elastic body 102Y is higher than the static friction F3 and the dynamic friction F4 between the shaft insertion part 103*a*Y of the bearing 103Y and the shaft 101Y, so that the primary transfer roller 5Y can be prevented from slipping relative to the intermediate transfer belt 15. Additionally, the length W4 of the primary transfer roller can be made longer than the image creation range W1, thus providing favorable transfer properties (because the image creation range W1 would be reliably prevented from being affected). However, when the static friction F3 and the dynamic friction F4 between the shaft insertion part 103*a*Y of the bearing 103Y and the shaft 101Y are high, it may be necessary to make the elastic body 102Y have a width of more than or equal to 5 mm, in order to increase the friction between the intermediate transfer belt 15 and the elastic body 102Y. As the width of the elastic body is increased, it may become necessary to reduce the length W4 of the primary transfer roller accordingly. Even if the length W4 of the primary transfer roller is somewhat shorter than the image creation range W1, a wraparound electric field would form a favorable primary transfer electric field at the edges of the image creation range W1, thereby attaining favorable transfer properties. However, if the width of the elastic body is further increased, part of the elastic body may extend into the image creation range W1, in which case it may be necessary to further reduce the length W4 of the metal roller, which leads to a decrease in the primary transfer electric field at the edges of the image creation range W1. As a result, favorable transfer properties would not be attained. In such a case, the elastic body 102Y is preferably made of a conductive material. By making the elastic bodies 102Y have conductive properties, the primary transfer bias applied from a high-voltage power source (not shown) to the conductive bearing 103Y can be applied to the elastic bodies 102Y via the shaft 101Y of the primary transfer roller. Thus, a primary transfer electric field can be formed between the elastic body 102Y and the photoconductive drum 1Y. Accordingly, even if it is necessary to increase the width of the elastic body 102Y and part of the elastic body 102Y extended into the image creation range W1, favorable transfer properties can be achieved. At the portion corresponding to the gap between the elastic body 102Y and the primary transfer roller 5Y, a favorable primary transfer electric field is formed by the wraparound electric field of the primary transfer roller 5Y and the wraparound electric field of the elastic body 102Y. Accordingly, favorable transfer properties can be achieved at the portion corresponding to the gap between the elastic body 102Y and the primary transfer roller 5Y. However, a conductive elastic body 102Y is generally expensive, and therefore the width of the elastic body 102Y is preferably more than or equal to 5 mm and less than or equal to 15 mm. Furthermore, even if the elastic body 102Y extended into the image creation range W1, preferable transfer properties would be achieved, and therefore the length of the intermediate transfer belt 15 in the shaft direction can be reduced, so that the apparatus can be made compact. In a case where at least part of the elastic body 102Y is located in the image creation range W1, the elastic body 102Y is to be compressed to the diameter of the primary transfer roller 5Y. A gap is preferably provided between each of the end surfaces of the primary transfer roller and the corresponding elastic bodies 102Y. When the elastic body 102Y is compressed by the force Ft received from the intermediate transfer belt 15, the elastic body 102Y expands sideways in accordance with the compressed volume. At this time, if the elastic body 102Y is in close contact with the end surfaces of the primary transfer roller 5Y, the primary transfer roller 5Y may hamper the elastic body 102Y from being compressed. As explained hereafter, providing a gap between the elastic body 102Y and the ends of the primary transfer roller 5Y solves this problem. Referring to FIG. 7, in some cases, the compressed volume of the elastic body 102Y may run onto the primary transfer roller 5Y. When the elastic bodies 102Y run onto the end portions of the primary transfer roller 5Y, the diameter at the end portions of the primary transfer roller 5Y becomes larger than the diameter at the other parts of the primary transfer roller 5Y (i.e., the other parts being the part between the end portions of the primary transfer roller 5Y). As a result, as shown in FIG. 7, gaps are formed between the intermediate transfer belt 15 and the primary transfer roller 5Y. In modification 1 where the elastic bodies 102Y are provided on the shaft 101Y of the primary transfer roller 5Y, the end portions of the primary transfer roller 5Y are close to the image creation range W1. Thus, the elastic bodies 102Y run onto the end portions of the primary transfer roller 5Y, and the end portions of the primary transfer roller 5Y becomes larger than the other parts of the primary transfer roller 5Y. Consequently, gaps are formed between the intermediate transfer belt 15 and the primary transfer roller 5Y. The gaps between the intermediate transfer belt 15 and the primary transfer roller 5Y are likely to extend into the image creation range W1. Furthermore, the parts U1 where the intermediate transfer belt 15 starts to lift up are likely to be included in the image creation range W1. As a result, as described above, the primary transfer electric field may decrease and an image with blank portions may be created. Furthermore, when the intermediate transfer belt 15 passes through the part where it contacts the primary transfer roller 5Y, the edges constantly become deformed, which leads to a decrease in the safety margin with respect to the durability of the belt.

Figure 8:
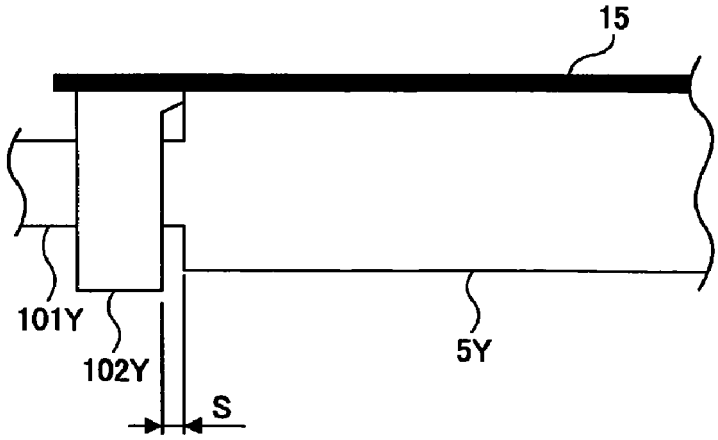
FIG. 8 is a schematic diagram illustrating a gap formed between the elastic body and the primary transfer roller according to an embodiment of the present invention.

For this reason, as shown in FIG. 8, the elastic body 102Y is fixed to the shaft 101Y of the primary transfer roller 5Y in such a manner that a gap S is formed between the elastic body 102Y and the end of the primary transfer roller 5Y. Accordingly, the elastic body 102Y can be compressed in a favorable manner. Furthermore, the elastic body 102Y that expands sideways as a result of compression is prevented from running onto the primary transfer roller 5Y. Thus, a stable transfer electric field can be formed. Such a configuration is also advantageous in terms of the durability of the intermediate transfer belt 15. When the diameter of the primary transfer roller 5Y is Φ8 mm, the outer diameter of the elastic body is Φ10 mm, and the amount of compression is 1 mm, the gap S between the end of the primary transfer roller 5Y and the elastic body 102Y is preferably more than or equal to 0.3 mm.

Figure 9:
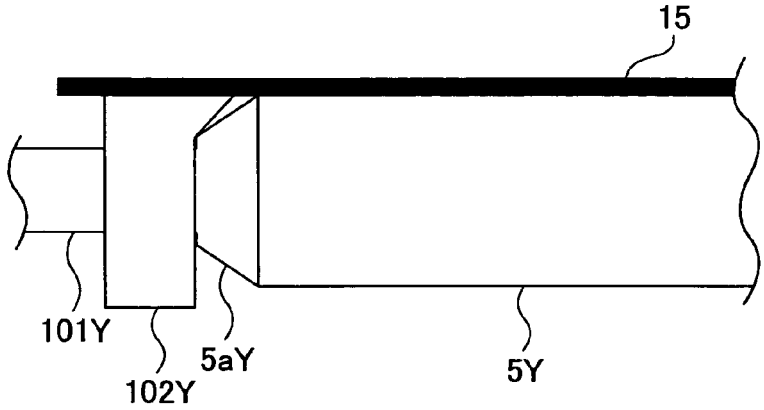
FIG. 9 is a schematic diagram illustrating a clearance formed at the end portion of the primary transfer roller according to an embodiment of the present invention.

Furthermore, as shown in FIG. 9, at the end of the primary transfer roller 5Y, there can be provided a clearance part 5*a*Y into which the elastic body 102Y can enter when compressed. This clearance part 5*a*Y has a tapered surface, such that the diameter decreases toward the end of the primary transfer roller 5Y. The clearance part 5*a*Y is not limited to a tapered surface. For example, the clearance part 5*a*Y can be formed by creating a step having a smaller diameter than that of the primary transfer roller 5Y, by cutting the primary transfer roller 5Y. By providing such a clearance part 5*a*Y, even if the compressed elastic body 102Y runs onto the end portion of the primary transfer roller 5Y, the end portion of the primary transfer roller 5Y is be prevented from becoming larger than the other parts of the primary transfer roller 5Y. Accordingly, it will be possible to prevent a gap from being formed between the primary transfer roller 5Y and the intermediate transfer belt 15, so that a stable transfer electric field can be formed, and favorable transfer properties can be achieved.

Figure 10:
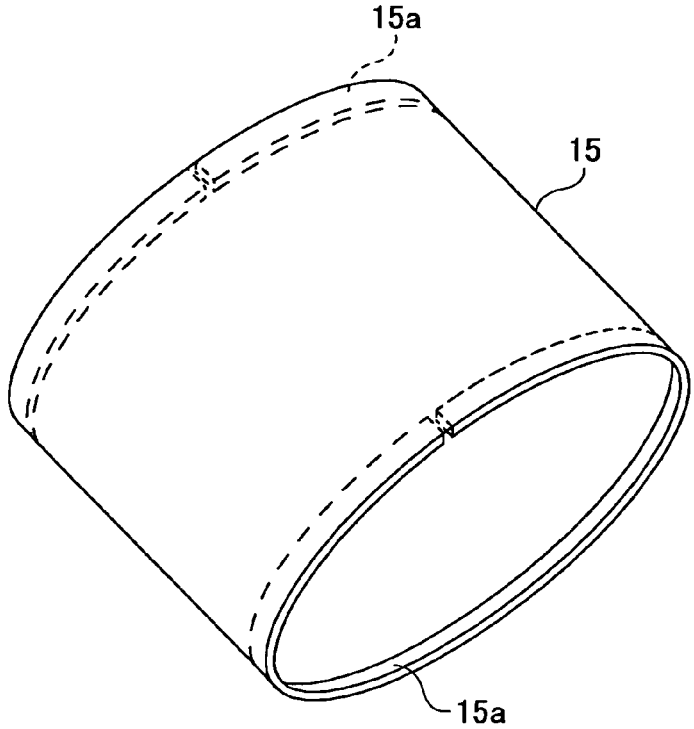
FIG. 10 illustrates an example in which reinforcement tape is provided along the edges of the intermediate transfer belt.
Figure 11:
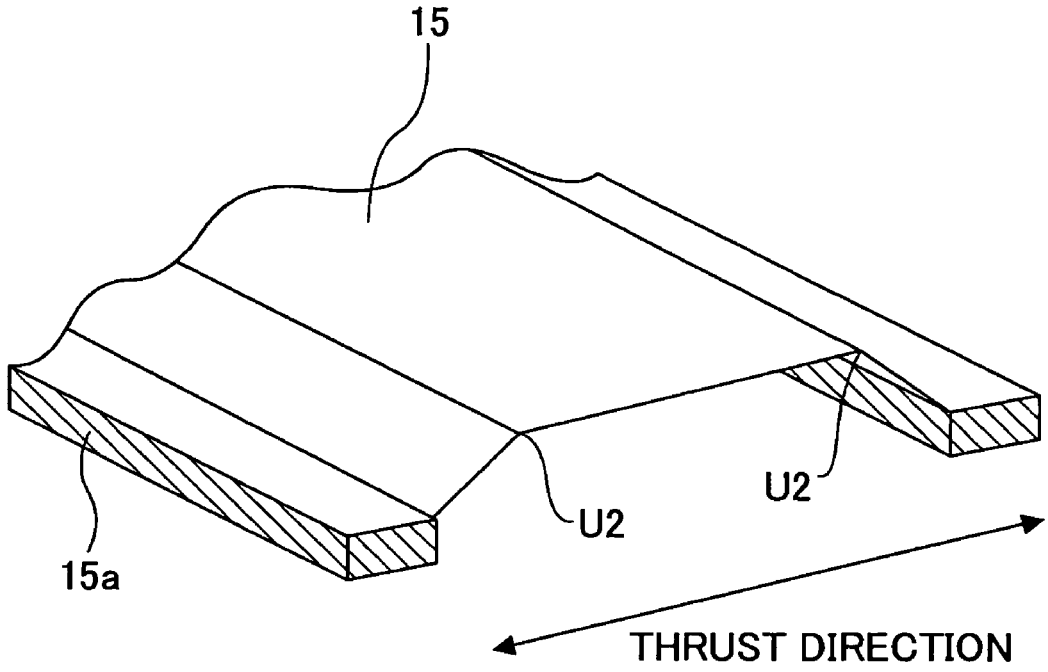
FIG. 11 is a cross-sectional view of the intermediate transfer belt when cut in a direction parallel to the shaft direction after being exposed in a high-temperature atmosphere.

Referring again to FIG. 2 now, the collars 20*a* are disposed against the edges of the intermediate transfer belt 15 primarily for the purpose of preventing the intermediate transfer belt 15 from moving sideways. Thus, the edges of the intermediate transfer belt 15 that contact the collars 20*a* may bend or buckle. For this reason, as shown in FIG. 10, reinforcement tape 15*a* which is a belt reinforcing member may be adhered to the edges of the intermediate transfer belt 15, in order to prevent the intermediate transfer belt 15 from bending or buckling. The reinforcement tape 15*a* is generally made of PET (polyethylene terephthalate). The reinforcement tape 15*a* may be fixed to the edges of the intermediate transfer belt 15 for example by an acrylic double-sided tape. When the intermediate transfer belt 15 is made of TPE (thermoplastic elastomer), the following problem may arise as PET and TPE have different thermal expansion coefficients. That is, when the belt is left in a high-temperature atmosphere (e.g., while being shipped in a container), PET has a lower thermal expansion coefficient than TPE, and therefore the edges of the intermediate transfer belt 15 will expand by a smaller amount than that of the other parts of the intermediate transfer belt 15. As a result, the edges of the intermediate transfer belt 15 will be positioned closer to the inside than the middle portions of the intermediate transfer belt 15. Specifically, when the intermediate transfer belt 15 is cut in a direction parallel to the shaft direction, the cross-sectional view of the intermediate transfer belt 15 appears to be a dome shape as shown in FIG. 11.

Figure 12A:
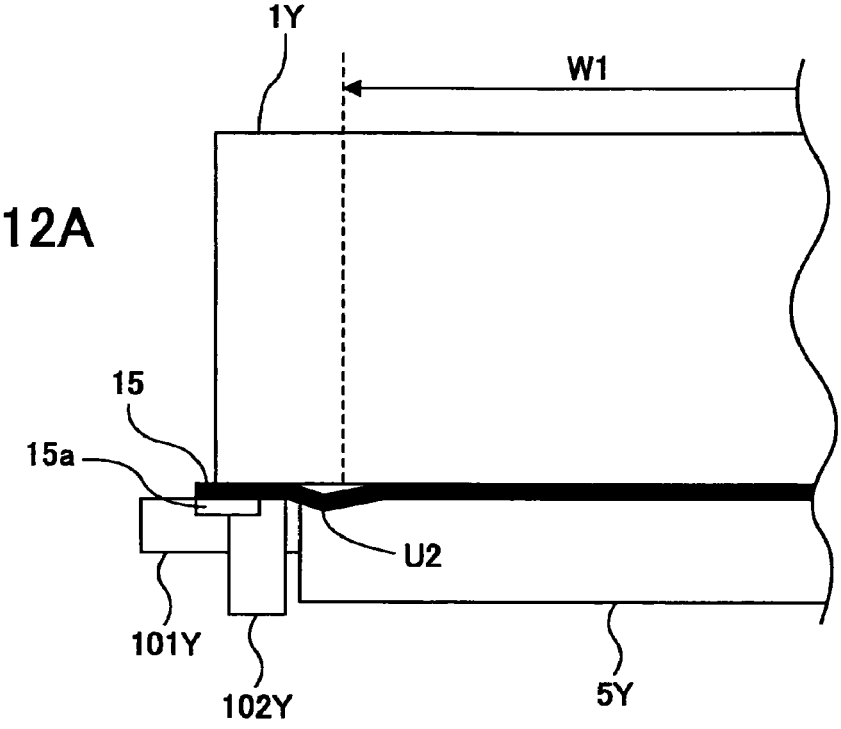
FIG. 12A is a schematic diagram of the area where the intermediate transfer belt is contacting the photoconductor.
Figure 12B:
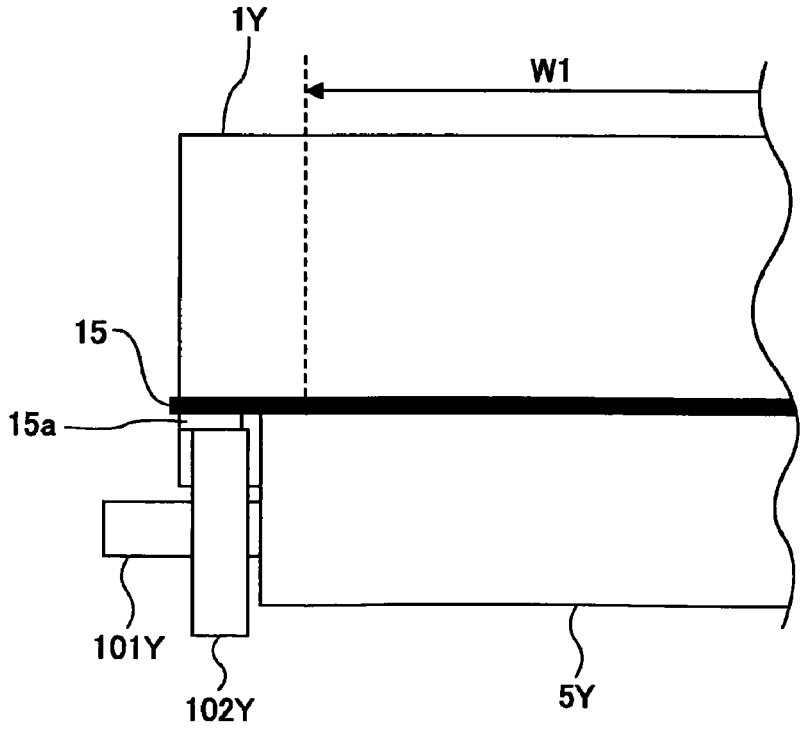
FIG. 12B is a schematic diagram of the area where the intermediate transfer belt is contacting the primary transfer roller.

When the elastic body 102Y provided on the shaft 101Y of the primary transfer roller 5Y is configured to come in contact with the reinforcement tape 15*a* on the back side of the intermediate transfer belt 15, the following problem arises. That is, when the part of the intermediate transfer belt 15 with such a dome-like cross-sectional shape comes into contact with the primary transfer roller 5Y, as shown in FIG. 12B, the elastic body 102Y will lift up the lowered edges of the intermediate transfer belt 15. As a result, as shown in FIG. 12A, at the location where the intermediate transfer belt 15 contacts the photoconductive drum 1Y, the part U2 at the edge where the intermediate transfer belt 15 starts to lower may buckle and separate from the surface of the photoconductive drum 1Y. A gap is formed as the part U2 buckles. If this gap extended into the image creation range W1, blank portions may be created at the edges of the image, thereby forming abnormal images.

Figure 13:
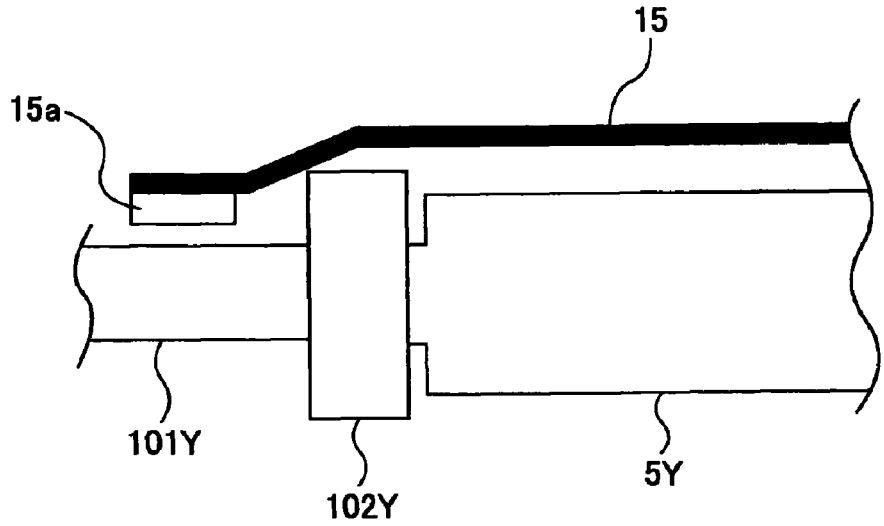
FIG. 13 is a schematic diagram illustrating elastic bodies being provided more toward the inside in the shaft direction than a reinforcement tape according to an embodiment of the present invention.
Figure 14:
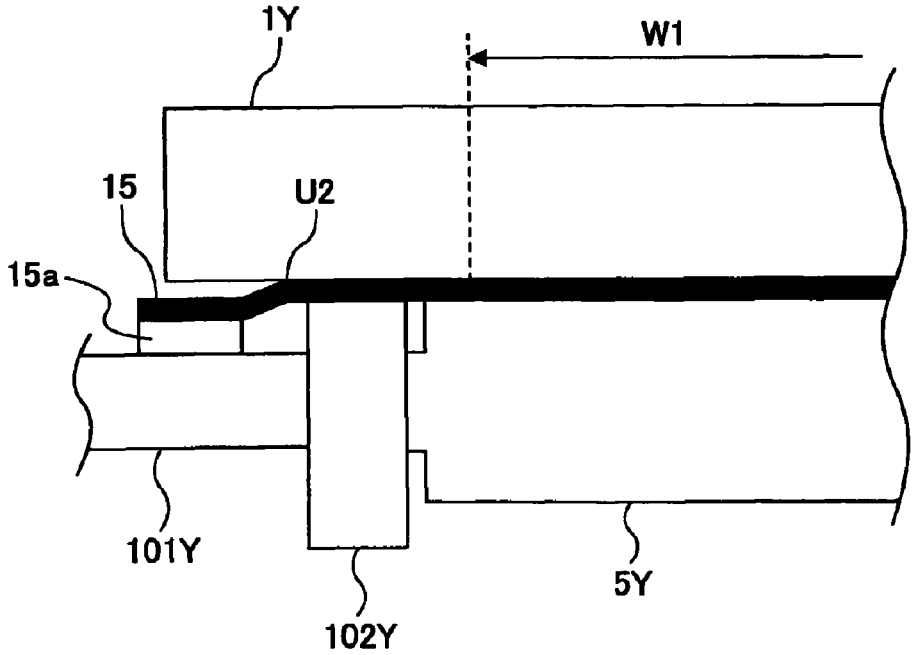
FIG. 14 is a schematic diagram of the area where the intermediate transfer belt is contacting the primary transfer roller in the case where the elastic bodies are provided more toward the inside in the shaft direction than the reinforcement tape according to an embodiment of the present invention.

Thus, when the reinforcement tape 15*a* is adhered to the edges of the intermediate transfer belt 15, as shown in FIG. 13, the elastic bodies 102Y are provided more toward the inside in the shaft direction than the reinforcement tape 15*a*. Therefore, as shown in FIG. 14, even when the part of the intermediate transfer belt 15 with the dome-like cross-sectional shape comes into contact with the primary transfer roller 5Y, the elastic bodies 102Y would not lift up the lowered edges of the intermediate transfer belt 15. Accordingly, at the location where the intermediate transfer belt 15 contacts the photoconductive drum 1Y, the parts U2 at the edges where the intermediate transfer belt 15 starts to lower are prevented from buckling. Thus, it is possible to prevent blank portions from being created at the edges of the image, thereby preventing abnormal images.

If desired, the elastic body 102Y can be provided on only one end of the shaft of the primary transfer roller 5Y. In such a case, it would still be possible to satisfy F1>F3, F2>F4, and the primary transfer roller 5Y would be prevented from slipping relative to the intermediate transfer belt 15. Furthermore, by providing the elastic body 102Y on only one end, the intermediate transfer belt 15 can be prevented from lifting up on the side of the shaft without the elastic body 102Y, thereby mitigating degraded image quality such as blanks.

It is to be noted that in the example illustrated in FIG. 3, the elastic bodies 102Y are provided at the "end portions" of the primary transfer roller 5Y. In the example illustrated in FIG. 4, the elastic bodies 102Y are provided on the "shaft 101Y" of the primary transfer roller 5Y. "Opposite ends" of the primary transfer roller 5Y refer to both of these cases, i.e., both the "end portions" of the primary transfer roller 5Y, and the "shaft 101Y".

The above description is given with respect to the primary transfer roller 5Y for yellow; the primary transfer rollers 5M, 5C, and 5K for M, C, and K also have the same configuration as the primary transfer roller 5Y.

In the present embodiment, a description is given of a full-color image forming apparatus; the present invention is similarly applicable to an image forming apparatus for one color (for example black and white), two colors, or three colors, etc.

In the present embodiment, a description is given of a case of transferring an image from the photoconductive drum to the intermediate transfer belt 15; the present invention is also applicable to a case of transferring an image from an image carrier to a recording sheet P carried on a belt member such as a recording material conveying belt.

The image forming apparatus according to the present invention includes a photoconductive drum acting as an image carrier for carrying a toner image on its surface; an intermediate transfer belt acting as an endless belt which moves endlessly while being stretched around plural stretching members, and forms a primary transfer nip by having its front surface contact the photoconductive drum; and a primary transfer roller acting as a transfer roller, which is rotated while contacting the region behind the primary transfer nip among the entire region on back side of the intermediate transfer belt, and which receives a primary transfer bias. Furthermore, the primary transfer roller is a metal roller, and is configured to slidably rotate in the bearing which supports the shaft of the primary transfer roller. Furthermore, F1>F3, F2>F4 is satisfied, where F1 is the maximum static friction between the primary transfer roller and the intermediate transfer belt; F2 is the dynamic friction between the primary transfer roller and the intermediate transfer belt; F3 is the maximum static friction between the shaft of the primary transfer roller and the shaft insertion parts (slide parts) of the bearings in which the shaft slidably rotates; and F4 is the dynamic friction between the shaft of the primary transfer roller and the shaft insertion parts of the bearings.

With the above configuration, the primary transfer roller is prevented from slipping, and abrasion powder is prevented from being generated. The powder would be generated if the primary transfer roller slipped and the back side of the intermediate transfer belt was scraped. Furthermore, as the abrasion powder is prevented from being generated, there will be no abrasion powder being electrically fused with the primary transfer roller. Even if abrasion powder were electrically fused with the primary transfer roller, the primary transfer roller is prevented from slipping, and therefore the abrasion powder electrically fused with the primary transfer roller would be prevented from forming a film. As a result, the resistance of the primary transfer roller can be maintained over time, and the primary transfer electric field is prevented from decreasing over time. Thus, the quality of the images can be maintained over time.

Furthermore, a metal roller is used as the primary transfer roller, and therefore the apparatus can be provided at low cost.

Furthermore, members having a higher friction coefficient than that of the surface of the metal roller are provided at the ends of the metal roller. Therefore, the maximum static friction between these members with a high friction coefficient and the intermediate transfer belt is higher than F3, and the dynamic friction between the same is higher than F4. As a result, the maximum static friction F1 between the primary transfer roller and the intermediate transfer belt can be higher than F3, and the dynamic friction between the primary transfer roller and the intermediate transfer belt can be higher than F2. Accordingly, the primary transfer roller can be prevented from slipping. Furthermore, the members with higher friction coefficients are provided only at the ends of the metal roller, and therefore the cost of the apparatus can be lower compared to the case of covering the entire surface of the metal roller with a member having a higher friction coefficient.

Furthermore, an elastic body is used as the member having a higher friction coefficient than the surface of the metal roller. Therefore, when the primary transfer roller is in an offset arrangement, and is receiving a pushing force from the photoconductive drum, the elastic bodies are compressed. Thus, at the edges of the image creation range of the photoconductive drum 1Y, gaps are prevented from being formed between the intermediate transfer belt 15 and the primary transfer roller 5Y, so that the primary transfer electric fields at the edges of the image creation range is prevented from decreasing. As a result, transfer failures are prevented at both edges of the image. Furthermore, the elastic body is compressed, and therefore the normal force can be increased, so that the friction between the intermediate transfer belt and the elastic bodies can be increased.

Furthermore, foamed polyurethane is used as the elastic body, and therefore the friction coefficient of the elastic body is prevented from decreasing when toner enters in between the components, so that F1>F3, F2>F4 can be maintained over time. Furthermore, the intermediate transfer belt can be prevented from being damaged/deformed over time. Furthermore, the intermediate transfer belt can be prevented from being deformed due to degradation caused by the voltage.

Furthermore, by using foamed polyurethane having an Asker C hardness of more than or equal to 20° and less than or equal to 50°, the following disadvantages are further mitigated. That is, a decrease in the friction coefficient of the elastic body which is caused by toner entering in between the components can be prevented, the intermediate transfer belt can be prevented from being damaged/deformed, and the intermediate transfer belt can be prevented from being deformed due to a decrease in the voltage.

Furthermore, by applying a lubricant to the shaft insertion part of the bearing, F3 and F4 can be decreased, and the safety margins of F1 and F2 can be increased.

Particularly, by applying a conductive lubricant to the shaft insertion part of the bearing made of conductive resin, electrical loss between the bearing 103Y and the primary transfer roller 5Y can be prevented, and the voltage of the high-voltage power source can be maintained at a low level.

Furthermore, $Fs<2T\sin(\theta/2)$ is satisfied, where T is the tension of the intermediate transfer belt, θ is the arc of contact between the primary transfer roller which is a metal roller and the intermediate transfer belt, and Fs is the force required for compressing the elastic body to the diameter of the primary transfer roller. Therefore, the elastic body can be compressed to the diameter of the primary transfer roller. Accordingly, a gap is prevented from being formed between the intermediate transfer belt and the primary transfer roller, so that favorable transfer properties can be achieved.

Furthermore, in the image forming apparatus according to modification 1 with the elastic bodies being provided on the shaft of the primary transfer roller, by providing a gap between the primary transfer roller and each of the elastic bodies, the elastic body can smoothly expand sideways (in the shaft direction) when the elastic body is compressed. Accordingly, compared to the case where the elastic body is contacting the end of the primary transfer roller, the elastic body can be compressed in a favorable manner with the force Ft ($2T\sin(\theta/2)$) from the intermediate transfer belt, and the elastic body is prevented from running onto the end portion of the primary transfer roller. As a result, the gap between the intermediate transfer belt and the primary transfer roller is prevented from extending to the image creation range, and a gap is prevented from being formed between the intermediate transfer belt and the photoconductor.

Furthermore, a clearance part is formed at each end of the primary transfer roller into which the elastic body can enter when the elastic body is compressed to a diameter that is smaller than the outer diameter of the primary transfer roller. Accordingly, even if the elastic body ran onto the end portion of the primary transfer roller when compressed, a gap would be prevented from being formed between the intermediate transfer belt and the primary transfer roller, because the end portions of the primary transfer roller have clearance parts having smaller diameters than the outer diameter of the primary transfer roller.

Furthermore, the clearance part can have a tapered surface, such that the diameter decreases toward the end of the primary transfer roller. With such a configuration, even if the elastic body ran onto the end portion of the primary transfer roller when compressed, a gap would be prevented from being formed between the intermediate transfer belt and the primary transfer roller.

Furthermore, in the image forming apparatus according to modification 1 with the elastic bodies being provided on the shaft of the primary transfer roller, when reinforcement tape acting as a belt reinforcing member is provided along both edges of the intermediate transfer belt, the elastic bodies having high friction coefficients are preferably provided more toward the inside in the shaft direction than the reinforcement tape. Thus, even if the apparatus were left in a high-temperature atmosphere and the edges of the intermediate transfer belt were deformed in such a manner as to be lowered toward the inside, the lowered edges of the intermediate transfer belt would be prevented from being lifted up by the elastic bodies when the intermediate transfer belt comes into contact with the primary transfer roller. Accordingly, at the location where the intermediate transfer belt contacts the photoconductor, the part where the intermediate transfer belt starts to lower is prevented from buckling and separating from the photoconductor.

Furthermore, the elastic body is conductive, and therefore a transfer electric field can be formed between the elastic body and the photoconductor. Accordingly, even if the elastic body were positioned in the image creation range W1, favorable transfer properties would be attained. As a result, the width of the elastic body can be increased, thereby reliably satisfying F1>F3, F2>F4. Thus, the transfer roller can be reliably prevented from slipping. Furthermore, favorable transfer properties would be attained even if the elastic body were positioned in the image creation range W1, and therefore the length of the intermediate transfer belt in the shaft direction can be shorter than the case of using a non-conductive elastic body, so that the apparatus can be made compact.

The inventors of the present invention obtained the following findings as a result of thoroughly studying the reason why the transfer roller slips relative to the endless belt member. That is, if the maximum static friction F3 between the shaft of the transfer roller and slide parts of the bearings in which the shaft slidably rotates were higher than the maximum static friction F1 between the transfer roller and the endless belt member, the transfer roller would slip on the endless belt member when the endless belt member starts to move. Furthermore, if the dynamic friction F4 between the shaft of the transfer roller and the slide parts of the bearings in which the shaft slidably rotates were higher than the dynamic friction F2 between the transfer roller and the endless belt member, the transfer roller would slip on the endless belt member when the endless belt member starts to move.

According to an embodiment of the present invention, the maximum static friction F3 between the shaft of the transfer roller and slide parts of the bearings in which the shaft slidably rotates is lower than the maximum static friction F1 between the transfer roller and the endless belt member, and the dynamic friction F4 between the shaft of the transfer roller and the slide parts of the bearings in which the shaft slidably rotates is lower than the dynamic friction F2 between the transfer roller and the endless belt member. Therefore, the transfer roller is prevented from slipping on the intermediate transfer belt (endless belt member). Accordingly, abrasion powder is prevented from being generated, which powder would be generated if the back side of the endless belt member were scraped by the transfer roller. Additionally, there would be no abrasion powder being electrically fused with the surface of the primary transfer roller. Even if abrasion powder were fused with the surface of the primary transfer roller, the primary transfer roller would be prevented from slipping, and therefore the abrasion powder would be prevented from forming a film on the surface of the transfer roller. As a result, the resistance of the transfer roller can be prevented from rising over time, and the transfer electric field can be stably formed over time. Thus, the quality of the images can be maintained over time.

Furthermore, a metal roller is used as the primary transfer roller, and therefore the apparatus can be provided at low cost.

The present invention is not limited to the specifically disclosed embodiment, and variations and modifications may be made without departing from the scope of the present invention.

The present application is based on Japanese Priority Patent Application No. 2008-035995, filed on Feb. 18, 2008, and Japanese Priority Patent Application No. 2008-298720, filed on Nov. 21, 2008, the entire contents of which are hereby incorporated herein by reference.

What is claimed is:

1. An image forming apparatus comprising:

an image carrier configured to carry a toner image on a surface thereof;

an endless belt member configured to move while being wound around plural belt support members and to form a transfer nip by having a front surface thereof contact the image carrier; and a transfer roller configured to be rotated while contacting a back surface of the endless belt member at a region corresponding to the transfer nip, and to receive a transfer bias, wherein:

at the transfer nip, the toner image on the image carrier is transferred onto the front surface of the endless belt member or onto a recording material held by the endless belt member;

the transfer roller is made of metal, and is configured to slidably rotate in bearings supporting a shaft of the transfer roller; and F1>F3 and F2>F4 are satisfied, where F1 is a maximum static friction between the transfer roller and the endless belt member, F2 is a dynamic friction between the transfer roller and the endless belt member, F3 is a maximum static friction between the shaft of the transfer roller and slide parts of the bearings in which the shaft slidably rotates, and F4 is a dynamic friction between the shaft of the transfer roller and the slide parts of the bearings in which the shaft slidably rotates, wherein:

end members having a higher friction coefficient than that of a surface of the transfer roller are provided at end portions of the transfer roller.

2. The image forming apparatus according to claim 1, wherein:

elastic members are used as the end members having the higher friction coefficient than that of the surface of the transfer roller.

3. The image forming apparatus according to claim 2, wherein:

foamed polyurethane is used as the elastic member.

4. The image forming apparatus according to claim 3, wherein:

the foamed polyurethane has an Asker C hardness of more than or equal to 20° and less than or equal to 50°.

5. The image forming apparatus according to claim 1, wherein:

a lubricant is applied to the slide parts of the bearings in which the shaft slidably rotates.

6. The image forming apparatus according to claim 5, wherein:

at least one of the bearings is made of conductive resin;

the transfer bias is applied to the transfer roller via the one of the bearings which is made of the conductive resin; and the lubricant applied to the slide part of the one of the bearings which is made of the conductive resin, comprises a conductive lubricant.

7. An image forming apparatus comprising:

an image carrier configured to carry a toner image on a surface thereof;

an endless belt member configured to move while being wound around plural belt support members and to form a transfer nip by having a front surface thereof contact the image carrier; and a transfer roller configured to be rotated while contacting a back surface of the endless belt member at a region corresponding to the transfer nip, and to receive a transfer bias, wherein:

at the transfer nip, the toner image on the image carrier is transferred onto the front surface of the endless belt member or onto a recording material held by the endless belt member;

the transfer roller is made of metal, and is configured to slidably rotate in bearings supporting a shaft of the transfer roller; and end members having a higher friction coefficient than that of a surface of the transfer roller are provided at opposite ends of the transfer roller.

8. The image forming apparatus according to claim 7, wherein: the end members are provided at end portions of the transfer roller.

9. The image forming apparatus according to claim 7, wherein:

the end members are provided on the shaft of the transfer roller.

10. The image forming apparatus according to claim 7, wherein:

elastic members are used as the end members having the higher friction coefficient than that of the surface of the transfer roller.

11. The image forming apparatus according to claim 10, wherein:

the elastic members are provided on the shaft of the transfer roller; and $Fs<2T \sin(\theta/2)$ is satisfied, where T is tension of the endless belt member, .theta. is an arc of contact between the transfer roller and the endless belt member, and Fs is force required for compressing the elastic member to a diameter of the transfer roller.

12. The image forming apparatus according to claim 10, wherein:

the elastic members are provided on the shaft of the transfer roller; and a gap is provided between each of the elastic members and the transfer roller.

13. The image forming apparatus according to claim 12, wherein:

a clearance part, which has a diameter that is smaller than an outer diameter of the transfer roller, is provided at each of the end portions of the transfer roller, such that the elastic member can enter the clearance part when compressed.

14. The image forming apparatus according to claim 13, wherein:

the clearance part has a tapered surface such that the diameter of the clearance part decreases toward the far end of the end portion of the transfer roller.

15. The image forming apparatus according to claim 7, wherein:

the end members having the higher friction coefficient than that of the surface of the transfer roller are provided on the shaft of the transfer roller;

belt reinforcement members are provided along opposite edges on the back surface of the endless belt member; and the end members having the higher friction coefficient than that of the surface of the transfer roller are provided more toward the inside in a shaft direction than the belt reinforcement members.

16. The image forming apparatus according to claim 7, wherein:

the end members having the higher friction coefficient than that of the surface of the transfer roller, are conductive.

17. A transfer unit for use in an image forming apparatus, the transfer unit comprising:

an endless belt member configured to move while being wound around plural belt support members and defining a transfer nip on a front surface thereof; and a transfer roller configured to be rotated while contacting a back surface of the endless belt member at a region corresponding to the transfer nip, and to receive a transfer bias, wherein:

the transfer roller is made of metal, and is configured to slidably rotate in bearings supporting a shaft of the transfer roller; and F1>F3 and F2>F4 are satisfied, where F1 is a maximum static friction between the transfer roller and the endless belt member, F2 is a dynamic friction between the transfer roller and the endless belt member, F3 is a maximum static friction between the shaft of the transfer roller and slide parts of the bearings in which the shaft slidably rotates, and F4 is a dynamic friction between the shaft of the transfer roller and the slide parts of the bearings in which the shaft slidably rotates, in combination with an image carrier, the image carrier being configured to carry a toner image on a surface thereof; and the image carrier contacting the endless belt member at the transfer nip; wherein:

at the transfer nip, the toner image on the carrier is transferred onto the front surface of the endless belt member or onto a recording material held by the endless belt member.

18. An image forming apparatus, comprising:

an image carrier configured to carry a toner image on a surface thereof;

an endless belt member configured to move while being wound around plural belt support members and to form a transfer nip by having a front surface thereof contact the image carrier; and a transfer roller configured to be rotated while contacting a back surface of the endless belt member at a position where the transfer roller is offset relative to the transfer nip in a moving direction of the endless belt member, and to receive a transfer bias, wherein:

at the transfer nip, the toner image on the image carrier is transferred onto the front surface of the endless belt member or onto a recording material held by the endless belt member;

the transfer roller is made of metal, and is configured to slidably rotate in bearings supporting a shaft of the transfer roller; and end members having a higher friction coefficient than that of a surface of the transfer roller are provided at opposite ends of the transfer roller.

19. The image forming apparatus according to claim 18, wherein the transfer roller contacts the endless belt member at a first position and is offset relative to a second position where the image carrier contacts the endless belt member in a direction extending from the back surface of the endless belt member toward the front surface of the endless belt member.

20. The image forming apparatus according to claim 18, wherein:

the end members are provided at end portions of the transfer roller.

21. The image forming apparatus according to claim 18, wherein:

the end members are provided on the shaft of the transfer roller.

22. The image forming apparatus according to claim 18, wherein:

elastic members are used as the end members having the higher friction coefficient than that of the surface of the transfer roller.

* * * * *